US007000367B2

(12) United States Patent
Sung

(10) Patent No.: US 7,000,367 B2
(45) Date of Patent: Feb. 21, 2006

(54) VACUUM PACKAGING MACHINE AND SYSTEM FOR CONTROLLING THE SAME

(76) Inventor: Yi-Je Sung, 35-1201, Dong-a Apt., Bupyeong-dong, Bupyeong-gu, Incheon-si, 403-762 (KR)

( * ) Notice: Subject to any disclaimer, the term of this patent is extended or adjusted under 35 U.S.C. 154(b) by 28 days.

(21) Appl. No.: 10/769,570

(22) Filed: Jan. 30, 2004

(65) Prior Publication Data

US 2005/0050860 A1 Mar. 10, 2005

(30) Foreign Application Priority Data

Sep. 9, 2003 (KR) ..... 10-2003-0063275
Sep. 15, 2003 (KR) ..... 10-2003-0063614
Dec. 22, 2003 (KR) ..... 10-2003-0094432

(51) Int. Cl.
*B65B 31/00* (2006.01)

(52) U.S. Cl. ..... 53/510; 53/512

(58) Field of Classification Search ..... 53/432, 53/433, 434, 510, 511, 512
See application file for complete search history.

(56) References Cited

U.S. PATENT DOCUMENTS 4,941,310 A * 7/1990 Kristen ..... 53/512
5,822,956 A * 10/1998 Liechti et al. ..... 53/510
5,893,822 A * 4/1999 Deni et al. ..... 53/512
6,256,968 B1 * 7/2001 Kristen ..... 53/512
6,694,710 B1 * 2/2004 Wang ..... 53/512

* cited by examiner

*Primary Examiner*—Eugene Kim
(74) *Attorney, Agent, or Firm*—Booth Udall, PLC

(57) ABSTRACT

The present invention relates to a vacuum packaging machine for vacuum sealing by putting food into a vacuum packaging bag, removing air from the vacuum packaging bag, and sealing an open portion of the vacuum packaging bag, and a system for controlling the vacuum packaging machine. The vacuum packaging machine includes a housing (10), a hood (20) and a separation unit (60). The housing (10) has a cover (11*b*) with a rubber packing (12) attached to a border thereof and an outlet (110*b*) formed therein, and a heater (16) for sealing a vacuum packaging bag. The hood (20) is hingedly connected to the housing (10) to selectively open and close a top of the housing (10), and has a rubber packing (22). The separation unit (60) communicates with the outlet (110*b*) through a communicating member and is connected to a vacuum pump. The vacuum packaging machine forms a vacuum through the vacuum pump when the rubber packings (22 and 12) of both the hood (20) and the housing (10) come into contact with each other. The separation unit (60) communicates with a filter means (80) having a filter casing (82) for filtering impurities or oil contained in the vacuum packaging bag, a filter (84) inserted into the filter casing (82) to remove the impurities, and a filter casing cover (86).

14 Claims, 19 Drawing Sheets

VACUUM PACKAGING MACHINE AND SYSTEM FOR CONTROLLING THE SAME

BACKGROUND OF THE INVENTION

1. Field of the Invention

The present invention relates, in general, to a vacuum packaging machine for forming a vacuum in a vacuum packaging bag to keep food in the vacuum packaging bag for long periods and a system for controlling the vacuum packaging machine and, more particularly, to a vacuum packaging machine, which selectively eliminates dregs and water flowing out from food contained in a vacuum packaging bag at the time of vacuum sealing by connecting an outlet formed in a cover to a separation unit, eliminates user's inconvenience of manually pressing a hood to form a vacuum by utilizing catches capable of closely pushing locking hooks formed on the hood, and cuts and utilizes the vacuum packaging bag in a required length by attaching a roll cartridge to a housing, and to a system for controlling the vacuum packaging machine, which improves a system of a conventional vacuum packaging machine that manually vacuum sealed a vacuum packaging bag to keep food for long periods, thus conveniently and automatically vacuum sealing the vacuum packaging bag in a one-touch manner.

2. Description of the Related Art

Generally, in order to keep raw food or cooked food, the food is packaged with wraps or vinyl papers and then stored in a freezing machine, such as a freezer. However, there is a problem in that the storage of food in a freezer is possible only for a predetermined period, and it is difficult to keep food for long periods because raw food and cooked food are oxidized and thus deteriorated due to air contained in the vacuum packaging bag.

In order to solve this problem, there has been developed and used a vacuum packaging machine for removing air from a vacuum packaging bag and sealing the vacuum packaging bag after the food to be kept is put into the vacuum packaging bag so as to keep the food for long periods by preventing raw food or cooked food from being oxidized and thus deteriorated.

That is, as shown in FIG. 1, a conventional vacuum packaging machine is constructed so that a hood 20 and a housing 10 are provided, rubber packings 12 and 22 are mounted in the housing 10 and the hood 20, respectively, to package a vacuum packaging bag after one end of the vacuum packaging bag is inserted into the hood 20, a pump 14 is provided to draw air contained in a vacuum packaging bag 50 using the upper and lower rubber packings 22 and 12, and a heater 16, which is a heating means for sealing the vacuum packaging bag 50, is placed in front of the lower rubber packing 12.

Through the above construction, after putting food to be stored into the vacuum packaging bag 50 and locating an inlet of the vacuum packaging bag between the upper and lower rubber packings 22 and 12, a user presses the upper rubber packing 22 formed in the hood 20 down so as to allow the upper and lower rubber packings 22 and 12 to come into contact with each other.

In this case, there is a problem in that a compulsory force is applied to the hood 20 so as to allow the upper and lower rubber packings 22 and 12 to come into contact with each other and then allow the vacuum packaging bag 50 to be completely sealed.

In this state, if the user presses a certain switch, the pump 14 is operated and a vacuum is formed in a space between the rubber packings 12 and 22 by the operation of the pump 14. If a vacuum packaging bag made of typical vinyl is used, air contained in the vacuum packaging bag 50 cannot be drawn by the upper and lower rubber packings 22 and 12. However, since embossed patterns 50*a* are formed on one side surface of the vacuum packaging bag 50, the air contained in the vacuum packaging bag 50 can be drawn by the embossed patterns 50*a*.

As described above, if the formation of a vacuum in the vacuum packaging bag 50 has been completed, power is supplied to the heater 16 placed in front of the lower rubber packing 12, and then the vacuum packaging bag 50 is thermally fused and sealed. Further, on the hood 20, a heater pressing packing 27 for pressing the vacuum packaging bag 30 is placed to allow the vacuum packaging bag 50 to be easily thermally fused. The heater 16 is implemented to enable the user to adjust the temperature thereof.

However, as described above, the conventional vacuum packaging machine is problematic in that a strong vacuum force acts in the vacuum packaging bag containing food to press the food, thus causing damage to the food, such as breaking or crushing the food. If a vacuum level of the vacuum packaging bag is decreased so as to prevent damage to the food, the food is oxidized and deteriorated due to oxygen remaining in the vacuum packaging bag and, thus, it is impossible to maintain optimum freshness of the food.

Further, a conventional vacuum packaging apparatus allowing for volumetric vacuum control disclosed in U.S. Pat. No. 6,256,968B1 is problematic in that, since oil or water cannot be separated by a separation assembly at the time of vacuumizing food, the oil or water flows into a pump, so that performance of the pump is deteriorated and a vacuumizing operation is unsanitary. Further, the vacuum packaging apparatus is problematic in that, since a cutter is mounted in a hood and a vacuum packaging bag can be easily cut after the vacuumizing operation; however, a device for cutting the vacuum packaging bag in a required length depending on the amount of food is not provided, so that the vacuum packaging bag must be separately cut in a certain length.

Further, another conventional vacuum packaging machine is disclosed in Korean Pat. No. 109619 entitled "Apparatus for vacuum sealing plastic bags" which is provided with a vacuum chamber means for eliminating impurities. However, the conventional vacuum sealing apparatus is problematic in that, since a vacuum is formed in a vacuum packaging bag after a vacuum is formed in the vacuum chamber means is drawn by a vacuum pump in the case where food not containing water or impurities is put into the vacuum packaging bag and a vacuum is formed therein, a vacuum speed is decreased. Further, the vacuum sealing apparatus is problematic in that, when a large number of impurities are contained in food, the impurities overflow the vacuum chamber means and flow into the vacuum packaging machine, and it is inconvenient in that impurities remaining in the vacuum chamber means must be eliminated at each time after the vacuum is formed in the vacuum packaging bag.

Further, such a conventional vacuum packaging machine is problematic in that, since a system for controlling the vacuum packaging machine is unstable, the following problems involving inconvenience to use are caused as well as the malfunction of the vacuum packaging machine.

First, in the case of a power supply scheme, the conventional vacuum packaging machine is supplied with typical Alternating Current (AC) power and used thereby, but the power supply scheme is complicated and unstable, so that malfunction, such as the halt of the vacuum packaging machine, occurs, thus shortening the lifespan of the vacuum packaging machine.

Further, a pump is generally operated to form a vacuum in a vacuum packaging bag. At this time, a sensing means for sensing the vacuum is constructed in an unstable mechanical manner, so that the reliability of sensed data is decreased.

Moreover, in the convention vacuum packaging machine, a system for monitoring setting and control states thereof is not implemented, so that it cannot provide convenience when using the vacuum packing machine to a user and, especially, a system for easily monitoring malfunction of the vacuum packaging machine even when the malfunction occurs in the vacuum packaging machine due to various factors, such as an unexpected accident, is not implemented.

SUMMARY OF THE INVENTION

Accordingly, the present invention has been made keeping in mind the above problems occurring in the prior art, and an object of the present invention is to provide a vacuum packaging machine, which can selectively eliminate oil or water flowing out from food contained in a vacuum packaging bag through the use of a filter.

Another object of the present invention is to provide a vacuum packaging machine, which is provided with a separation unit capable of eliminating oil and water flowing out from food contained in a vacuum packaging bag.

A further object of the present invention is to provide a vacuum packaging machine, which removes a conventional problem in which a hood is manually pressed by hand to form a vacuum in a vacuum packaging bag at the time of the vacuumizing operation, thus automatically performing the vacuumizing operation.

Still another object of the present invention is to provide a vacuum packaging machine, in which a roller with a vacuum packaging bag wound thereon is attached to a side thereof, and the roller is provided with a cutter capable of cutting the vacuum packaging bag.

Still another object of the present invention is to provide a system for controlling a vacuum packaging machine, which controls the vacuum packaging machine to be operated in a one-touch automatic manner and, especially, to be supplied with power in a Switching Mode Power Supply (SMPS) manner, so that the vacuum packaging machine is stably operated, thus solving a conventional problem in which the lifespan of the vacuum packaging machine is shorter.

Still another object of the present invention is to provide a system for controlling a vacuum packaging machine, which can improve the reliability of sensed data while facilitating the sensing of a vacuum by utilizing an electronic sensing means, without utilizing a conventional mechanical sensing means which was used to sense a vacuum according to the operation of a pump.

Still another object of the present invention is to provide a system for controlling a vacuum packaging machine, which easily controls all operating states of the vacuum packaging machine including the setting of user's desired vacuum pressure and sealing time and the selection of a container mode, thus improving convenience when using the vacuum packaging machine.

In order to accomplish the above object, the present invention provides a vacuum packaging machine, comprising a housing having a cover with a rubber packing attached to a border thereof and an outlet formed therein, and a heater for sealing a vacuum packaging bag; a hood hingedly connected to the housing to selectively open and close a top of the housing, the hood having a rubber packing; and a separation unit communicating with the outlet through a communicating member and connected to a vacuum pump; wherein the vacuum packaging machine forms a vacuum through the vacuum pump when the rubber packings of both the hood and the housing come into contact with each other.

Preferably, the separation unit may comprise an inlet port and an outlet port.

Preferably, the vacuum packaging machine may further comprise a communicating pipe connected to both the inlet port and the outlet port of the separation unit.

Preferably, the separation unit may communicate with filter means comprising a filter casing, a filter inserted into the filter casing to eliminate the impurities, and a filter casing cover.

Further, the present invention provides a vacuum packaging machine, comprising a housing having a separation assembly with a rubber packing attached to a border thereof and a heater for sealing a vacuum packaging bag, the separation assembly including a separation assembly casing having an outlet formed therein, and a cover mounted on the casing and provided with an inlet formed in a top surface thereof and a rubber packing; and a hood hingedly connected to the housing to selectively open and close a top of the housing, the hood having a rubber packing; wherein the vacuum packaging machine forms a vacuum through a pump when the rubber packings of both the hood and the housing come into contact with each other.

Preferably, the separation assembly may be inserted into a depression formed in the housing to be detachable from the housing.

Preferably, the rubber packing inserted into the cover of the housing may be constructed so that a plurality of projections are oppositely formed along an inner circumference thereof and channel parts are formed therein at locations where the projections face each other, and the rubber packing inserted into the hood may be constructed so that a plurality of holes are formed therein at locations corresponding to those of the channel parts, so that vacuum spaces are formed when the channel parts and the holes come into contact with each other.

Preferably, the rubber packing inserted into the cover of the housing may be constructed so that a plurality of holes are formed therein; and the rubber packing inserted into the hood may be constructed so that a plurality of each having both side notches by which channel grooves are formed are formed at locations corresponding to those of the holes in the rubber packing inserted into the cover, so that vacuum spaces can be formed when the holes of the cover and the hood come into contact with each other.

Further, the present invention provides a vacuum packaging machine, comprising a housing having a cover with a rubber packing attached to a border thereof and a heater for sealing a vacuum packaging bag, the housing having at least one catch; and a hood hingedly connected to the housing to selectively open and close a top of the housing, the hood having a rubber packing and at least one locking hook formed thereon to be locked with the catch; wherein the vacuum packaging machine forms a vacuum through the vacuum pump when the rubber packings of the hood and the housing come into contact with each other; and wherein the catch pushes the locking hook down and thus a vacuum is formed in vacuum spaces.

Preferably, the catch may include a catching bar having a first end held by the housing and a second end operated in conjunction with a stepping motor, and a connection member for connecting the catching bar to a rotation shaft of the stepping motor.

Preferably, the catch may include two catching bars each having a first end held by the housing and a second end operated in conjunction with a stepping motor, the two catching bars being connected to each other through a fixing portion.

Preferably, the housing is provided with a stopper, so that the stepping motor stops an operation thereof when the catching bar is locked with the stopper.

Preferably, the vacuum packaging machine may further comprise a roll cartridge containing a vacuum packaging bag roll, the roll cartridge being attached to a rear wall of the housing.

Preferably, the housing may include a locking hole formed therein; and the roll cartridge may include a locking projection formed thereon to be detachable from the locking hole.

Preferably, the roll cartridge includes a cover mounted thereon to protect the vacuum packaging bag, the cover being rotated around a rotation shaft formed on an outer circumference of the roll cartridge at a predetermined angle.

Preferably, the cover may include cutting means mounted thereon to allow the vacuum packaging bag to be cut and used in a certain length.

Preferably, the cover may include a slot formed therein to allow the cutting means to cut the vacuum packaging bag while moving along the slot.

Preferably, the cutting means may include a cutter, a casing for accommodating the cutter and a handle for allowing the cutter to cut the vacuum packaging bag while moving the cutter along the slot.

Preferably, the cutting means may include a fastening portion placed below the cutter, thus securely fastening the vacuum packaging bag at the time of cutting operation.

Further, the present invention provides a system for controlling a vacuum packaging machine having a housing having a depression formed therein, a heater placed on the housing to seal a vacuum packaging bag at a predetermined temperature, a pump placed in the housing to eliminate air remaining in the vacuum packaging bag and form a vacuum in the vacuum packaging bag, a pressure sensor for measuring a pressure of the vacuum formed through the pump, and a power supply unit for supplying operating power to both the pump and the pressure sensor, the system comprising a switch unit for selecting various modes and setting data after the power is supplied from the power supply unit; a control unit supplied with the power from the power supply unit and driven thereby, the control unit receiving electrical signals output from both the switch unit and the pressure sensor and then outputting control signals to both the pump and the heater; a timer electrically connected to the control unit to provide exact time information; and a display unit for receiving the output signals from the control unit and displaying various operating states of the vacuum packaging machine.

Preferably, the vacuum packaging machine control system may further comprise a memory unit for storing therein input/output data of the control unit, the memory unit being implemented as an Electrically Erasable Programmable Read Only Memory (EEPROM).

Preferably, the power supply unit is operated in a Switching Mode Power Supply (SMPS) manner.

Preferably, the switch unit may comprise a vacuumizing and sealing mode switch selected to automatically and sequentially perform vacuumizing and sealing functions, a sealing mode switch selected to perform only a sealing function, a container mode switch selected to seal a separate container, a vacuum pressure setting switch selected to set user's desired vacuum pressure after the vacuumizing and sealing mode switch is selected, a sealing time setting switch, a drive switch to select drive of the vacuum packaging machine after data are input through the switches, and a cancel switch to stop the drive of the vacuum packaging machine.

Preferably, the display unit may be operated in response to data output from the control unit, and may comprise vacuum pressure setting indication lamps for displaying corresponding set values whenever a user sets a vacuum pressure, sealing time indication lamps for displaying corresponding set values whenever the user sets a sealing time, and mode indication lamps for displaying corresponding set values whenever the user sets a mode.

Preferably, the vacuum packaging machine control system may further comprise a buzzer for outputting a predetermined alarm when a sealing time set by the user has elapsed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, embodiments of the present invention will be described in detail with reference to the attached drawings.

In the present specification, if it is determined that a detailed description of related art or construction unnecessarily makes the gist of the present invention unclear, the detailed description thereof will be omitted.

Further, terms, which will be described later, are set in consideration of functions in the present invention, and may differ according to intensions or usages of producers producing vacuum packaging machine products, so that the terms should be defined on the basis of entire contents of the present specification.

FIGS. 2 to 9 illustrate a vacuum packaging machine for vacuum sealing a vacuum packaging bag. The vacuum packaging machine is a device for discharging air remaining in a vacuum packaging bag into which food is put. The vacuum packaging bag containing the food is comprised of upper and lower panels with the sides and bottoms thereof sealed up and tops thereof opened, so that food, liquid or other contents can be inserted into the vacuum packaging bag through the tops thereof. Further, the vacuum packaging bag has embossed patterns formed thereon to prevent the occurrence of an initial breakage phenomenon at the time of drawing air through the vacuum packaging machine. For the vacuum packaging bag with the embossed patterns, a vacuum packaging bag having double projections formed thereon, which was disclosed in Korean Pat. Appl. No. 2003-0056318, is used.

Further, the vacuum packaging machine of the present invention can vaccumize a canister including a cover equipped with a valve employed to utilize the present invention.

Figure 1:
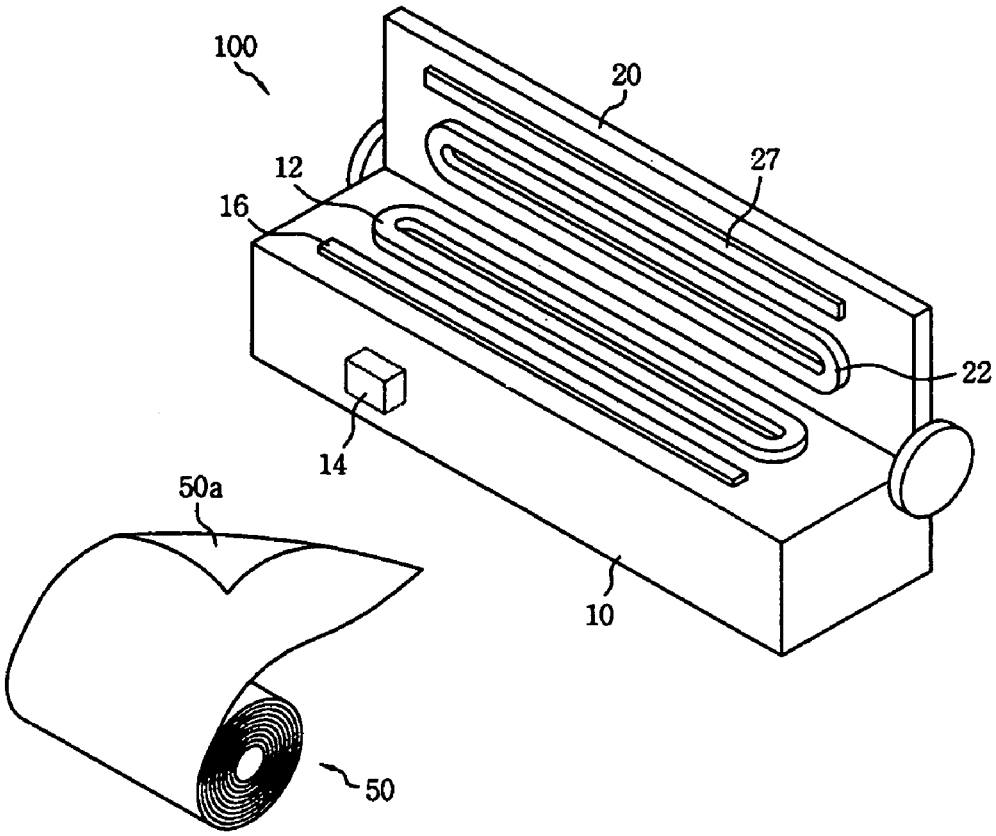
FIG. 1 is a perspective view showing the construction of a conventional vacuum packaging machine.
Figure 2:
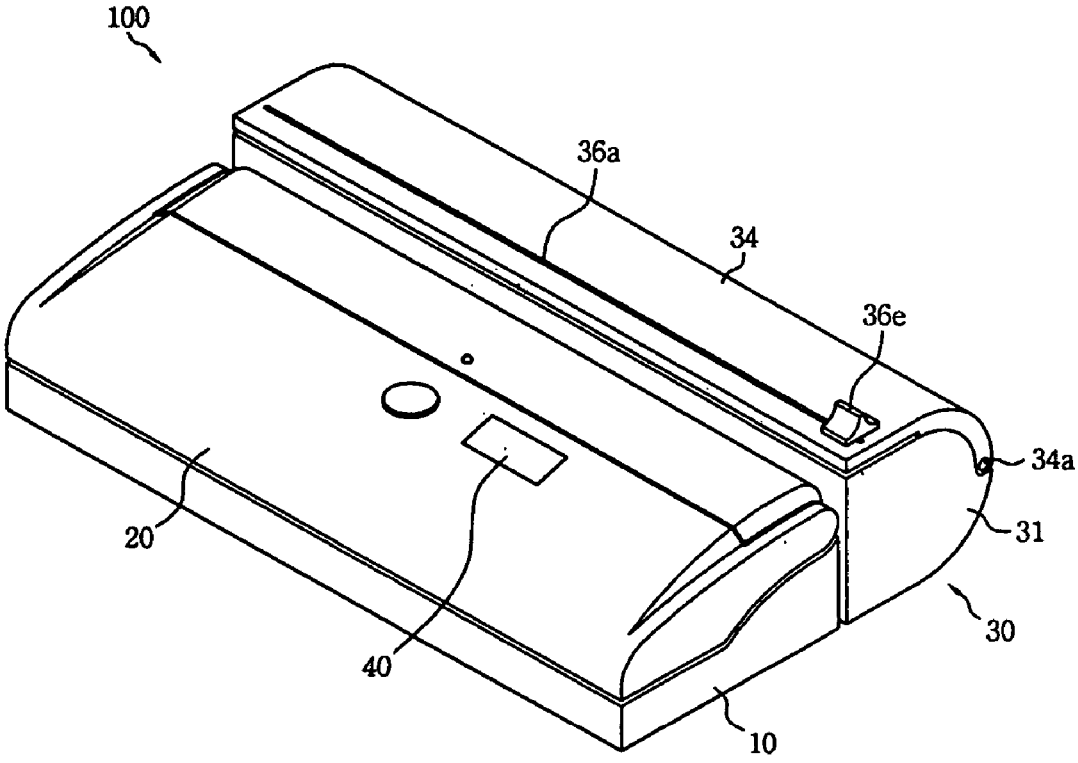
FIG. 2 is a perspective view showing the external shape of a vacuum packaging machine according to the present invention.
Figure 3:
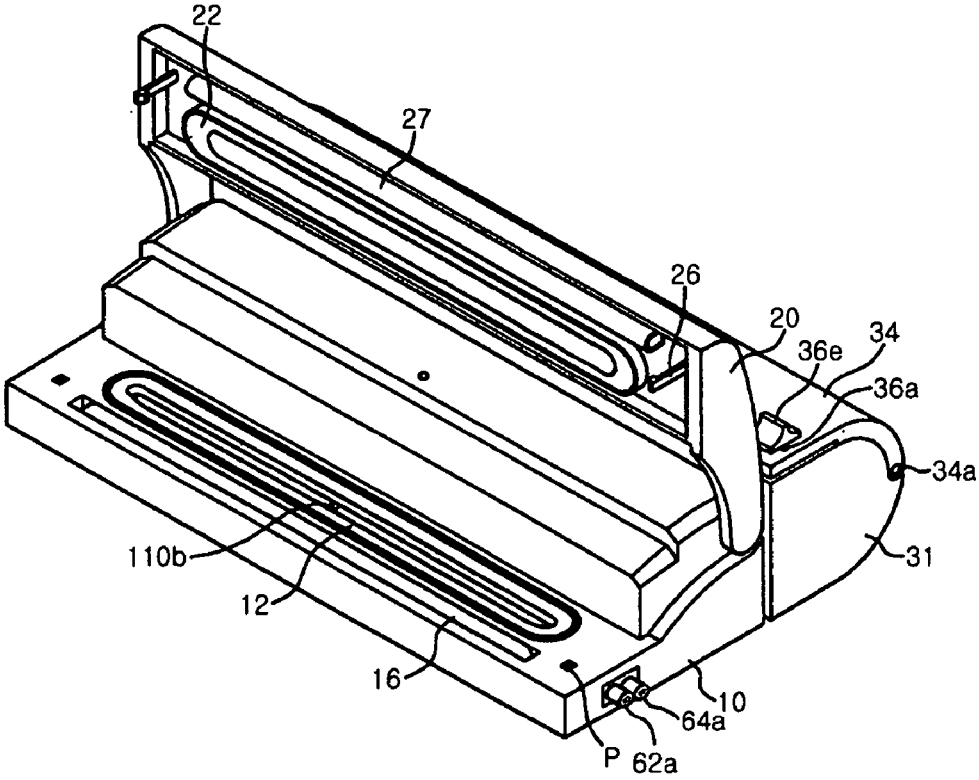
FIG. 3 is a perspective view showing a state in which a hood of the vacuum packaging machine is opened so as to describe in detail the vacuum packaging machine according to an embodiment of the present invention.
Figure 4:
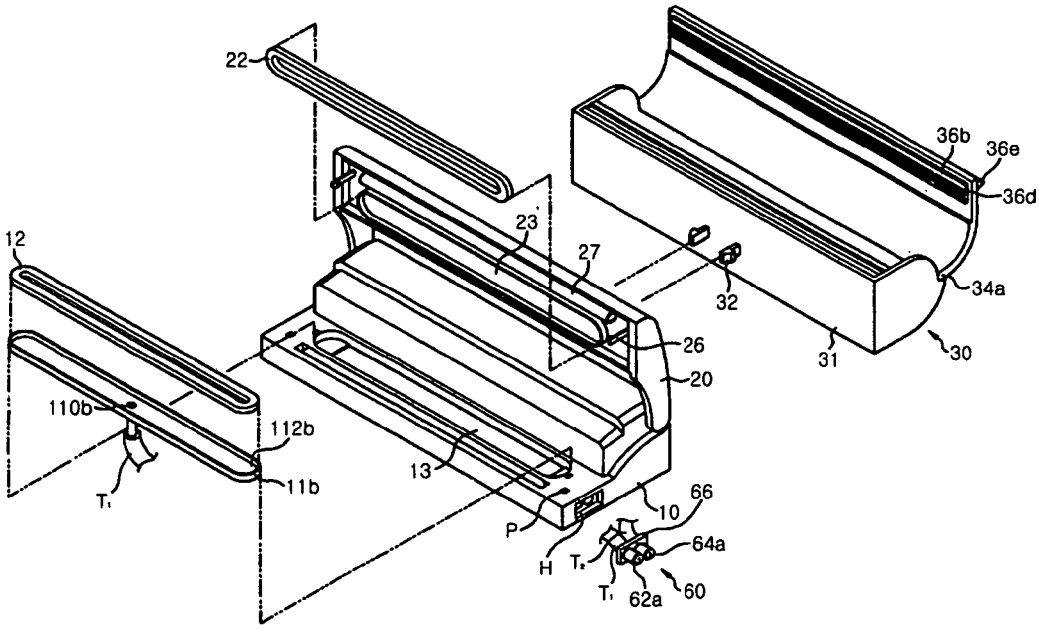
FIG. 4 is an exploded perspective view of the vacuum packaging machine of FIG. 3.
Figure 5A:
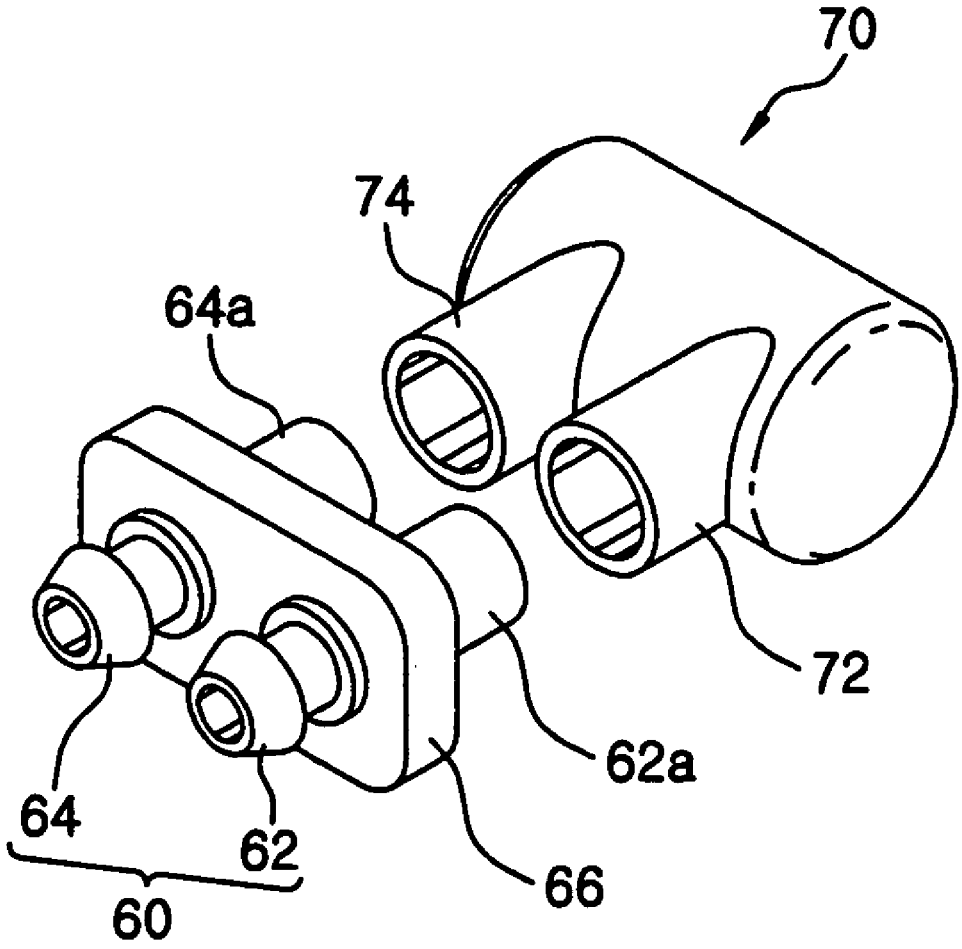
FIGS. 5*a* and 5*b* are a perspective view showing a separation unit of FIG. 3 and a communicating pipe connected to the separation unit, and a perspective view showing the separation unit and a filter means communicating with the separation unit, respectively.
Figure 5B:
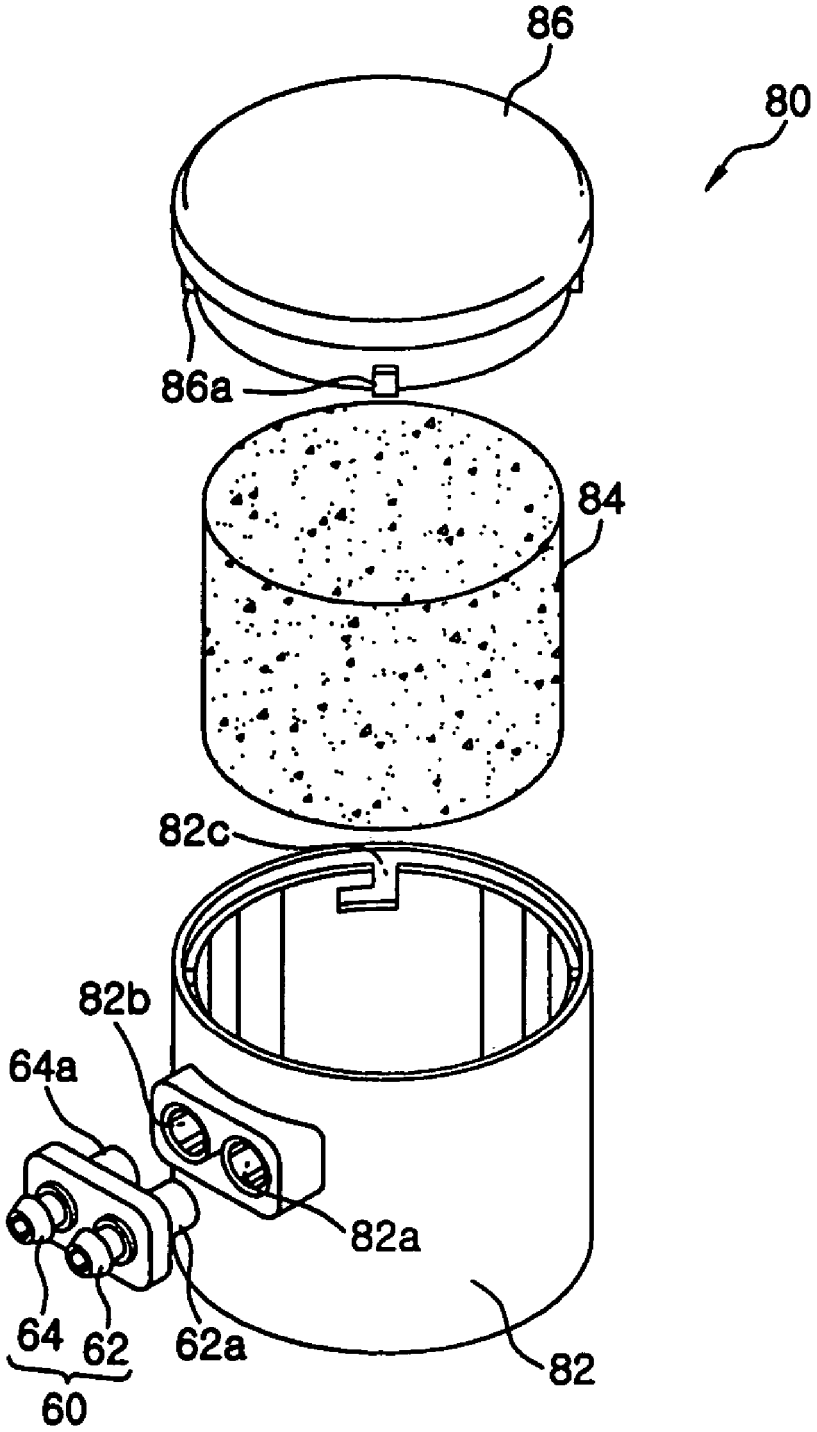
Figure 6A:
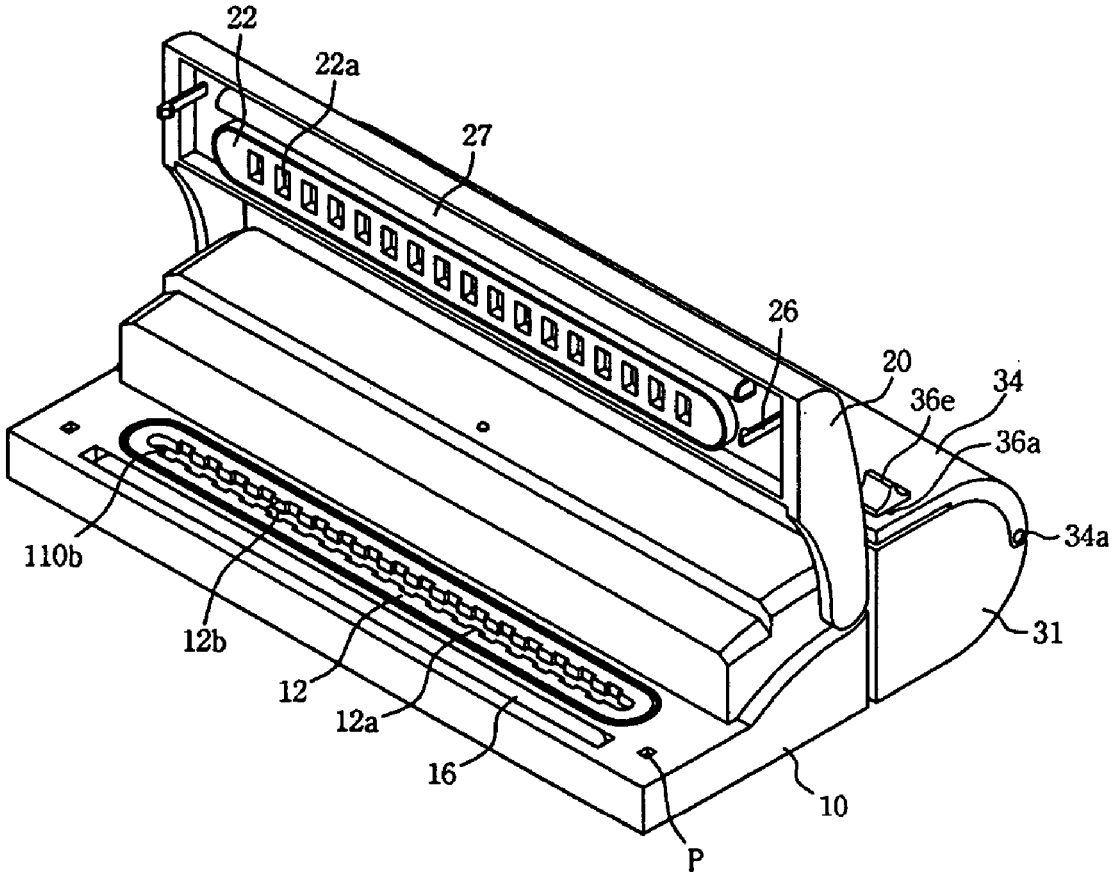
FIG. 6*a* is a perspective view showing a state in which a hood of the vacuum packaging machine is opened so as to describe in detail the vacuum packaging machine according to another embodiment of the present invention.
Figure 6B:
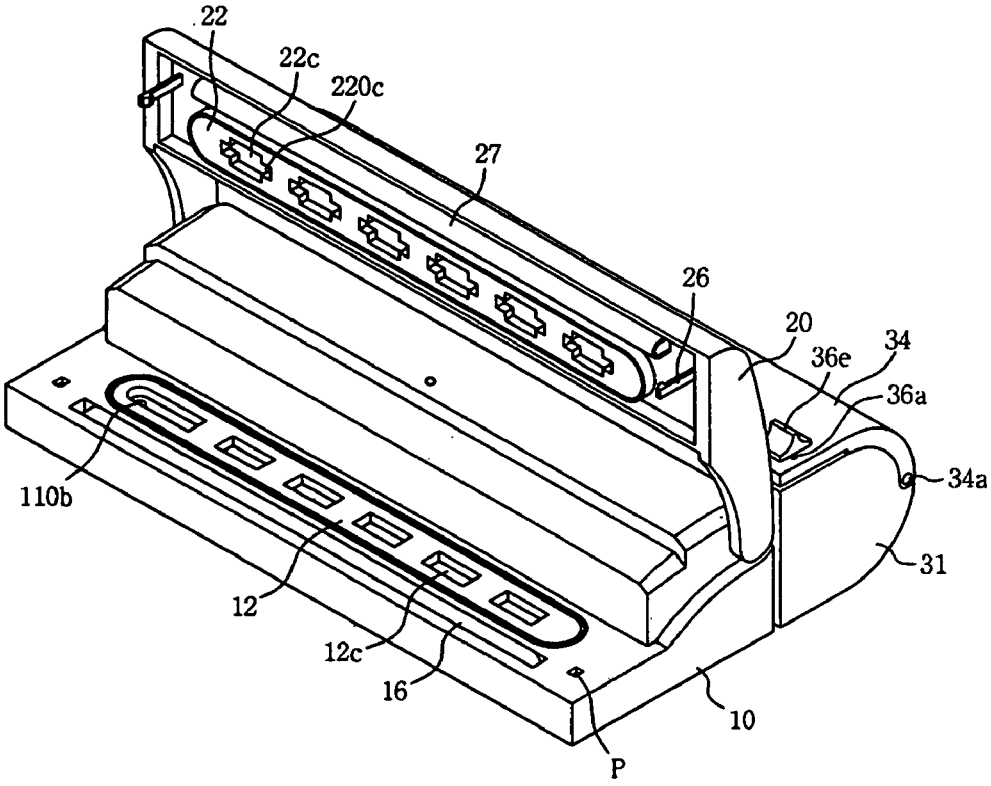
FIG. 6*b* is a perspective view showing a state in which a hood of the vacuum packaging machine is opened so as to describe in detail the vacuum packaging machine according to a further embodiment of the present invention.
Figure 7:
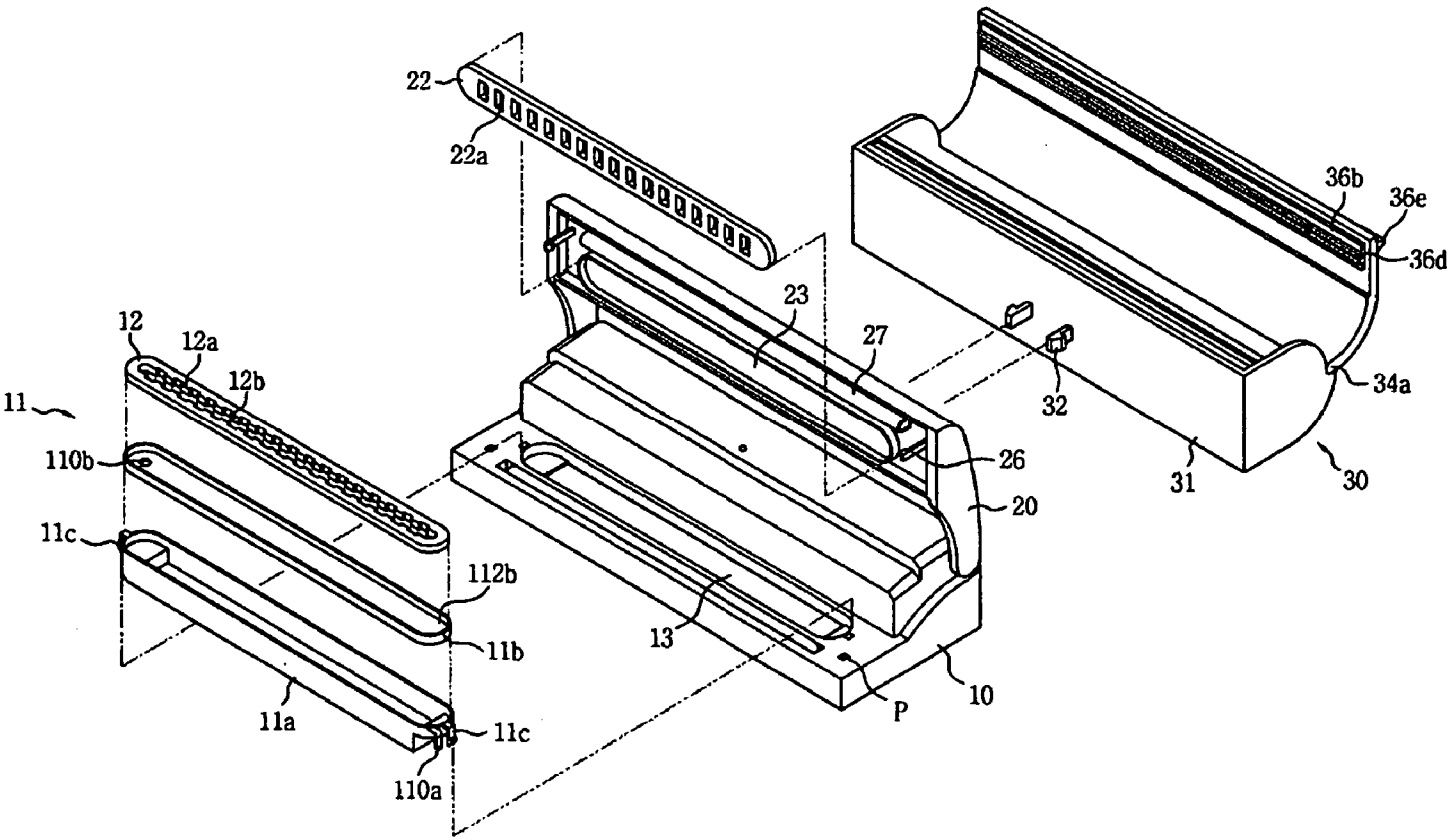
FIG. 7 is an exploded perspective view of the vacuum packaging machine of FIG. 6*a;*
Figure 8:
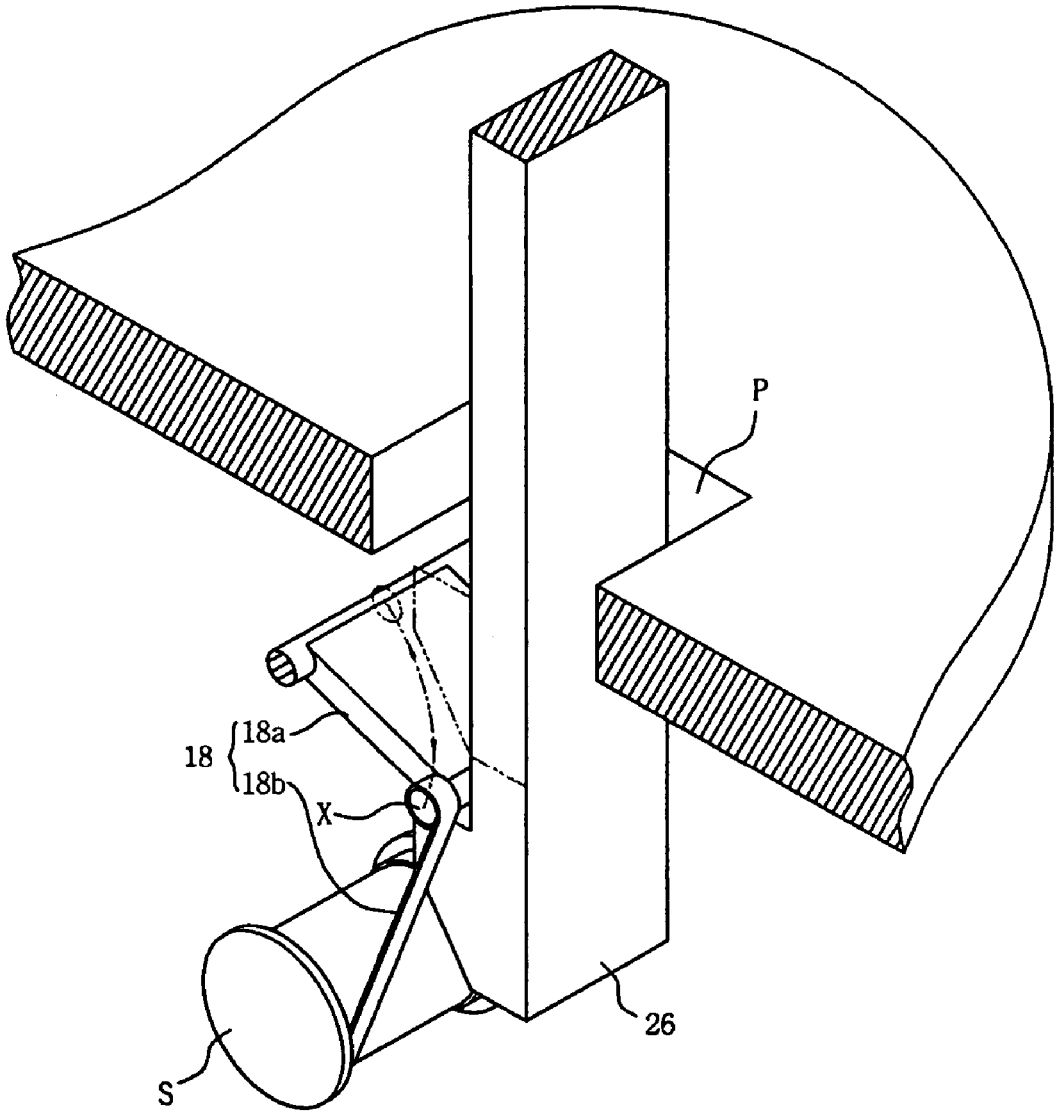
FIG. 8 is a perspective view showing an operational relation between a locking hook formed on a hood and a catch formed in a housing for sealing a separation assembly of the present invention.
Figure 9A:
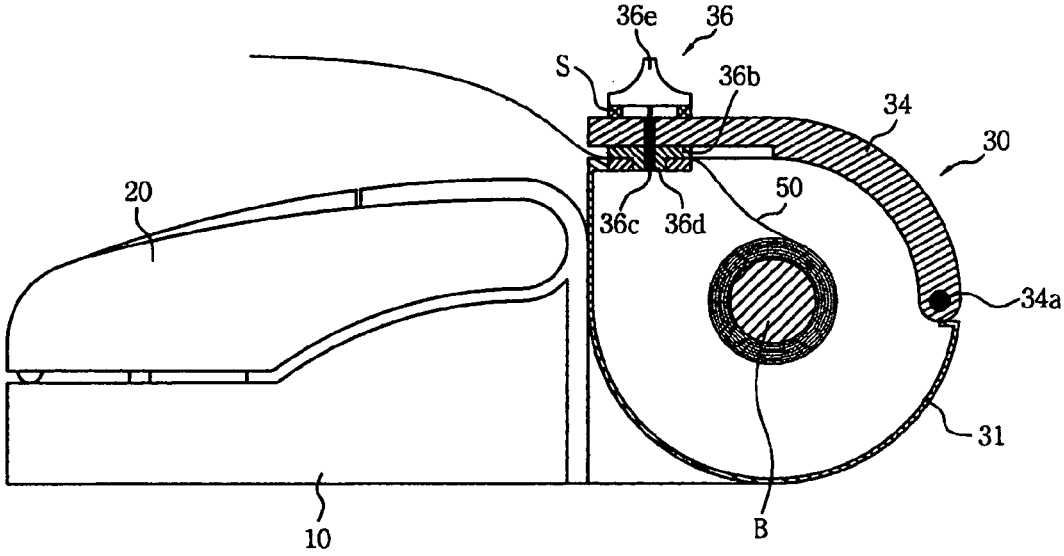
FIGS. 9*a* and 9*b* are sectional views showing a roll cartridge.
Figure 9B:
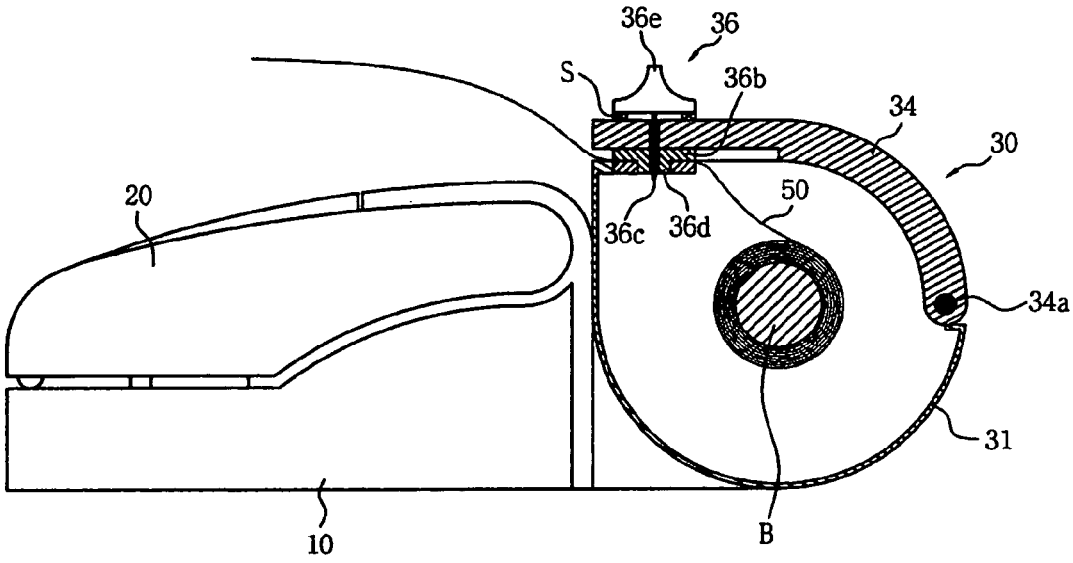

FIG. 2 is a perspective view showing the external shape of a vacuum packaging machine according to the present invention, FIG. 3 is a perspective view showing a state in which a hood of the vacuum packaging machine is opened so as to describe in detail the vacuum packaging machine according to an embodiment of the present invention, FIG. 4 is an exploded perspective view of the vacuum packaging machine of FIG. 3, FIGS. 5*a* and 5*b* are a perspective view showing a separation unit of FIG. 3 and a communicating pipe connected to the separation unit, and a perspective view showing the separation unit and a filter means communicating with the separation unit, respectively, FIG. 6*a* is a perspective view showing a state in which a hood of the vacuum packaging machine is opened so as to describe in detail the vacuum packaging machine according to another embodiment of the present invention, FIG. 6*b* is a perspective view showing a state in which a hood of the vacuum packaging machine is opened so as to describe in detail the vacuum packaging machine according to a further embodiment of the present invention, FIG. 7 is an exploded perspective view of the vacuum packaging machine of FIG. 6*a*, FIG. 8 is a perspective view showing an operational relation between a locking hook formed on a hood and a catch formed in a housing for sealing a separation assembly of the present invention, and FIGS. 9*a* and 9*b* are sectional views showing a roll cartridge.

Referring to FIGS. 2 to 5, a vacuum packaging machine 100 of the present invention is constructed to comprise a housing 10 having a cover 11*b* with a rubber packing 12 attached thereto and a heater 16 placed a certain distance directly in front of the cover 11*b* and used to seal a vacuum packaging bag, a hood 20 hingedly connected to a portion of the housing 10 and rotated at a certain angle to selectively open and close the housing 10, a vacuum packaging bag roll cartridge 30 detachably attached to a rear surface of the housing 10, and a separation unit 60 communicating with an outlet 110*b* of the cover 11*b* and inserted into a receiving hole H formed in a side wall of the housing 10.

A groove 112*b* for allowing the rubber packing 12 to be mounted therein is formed in the border of the cover 11*b*, so that the rubber packing 12 is inserted into the groove 112*b*.

The separation unit 60 is comprised of an inlet port 62, an outlet port 64, a partition 66 used to fix both the inlet port 62 and the outlet port 64 into the receiving hole H formed in the side wall of the housing 10, and an inlet portion 62*a* and an outlet portion 64*a* formed on a rear surface of the partition 66 to communicate with the inlet port 62 and the outlet port 64, respectively. The inlet port 62 communicates with the outlet 110*b* of the cover 11*b* through a tube T1, and the outlet port 64 communicates with an inlet (not shown) of a vacuum pump (not shown) through a tube T2.

If food having a minimal amount of water or minimal impurities or no water or no impurities needs to be put into a vacuum packaging bag and vacuum sealed, the separation unit 60 is inserted into a communicating pipe 70, as shown in FIG. 5*a*.

The communicating pipe 70 is comprised of an inlet pipe 72 and an outlet pipe 74 connected to the inlet portion 62*a* and the outlet portion 64*a*, respectively. The inlet pipe 72 and the outlet pipe 74 communicate with each other to serve to guide air to the vacuum pump (not shown).

Further, if food having a high water content or many impurities needs to be put into a vacuum packaging bag and vacuum sealed, the communicating pipe 70 is disconnected from the separation unit 60, and the inlet portion 62*a* and the outlet portion 64*a* of the separation unit 60 are inserted into a filter means 80.

The filter means 80 is comprised of a filter casing 82, a filter 84 inserted into the filter casing 82 to remove impurities, and a filter casing cover 86.

The filter casing 82 has an inlet hole 82*a* and an outlet hole 84*a* formed in an outer surface thereof to allow the inlet portion 62*a* and the outlet portion 64*a* to be inserted thereinto, respectively. Further, the filter casing 82 has a circular groove 82*c* is formed in an upper inner circumference thereof to receive a projection 86*a* formed on a lower outer circumference of the cover 86, thus allowing the cover 86 to be detachably attached to the casing 82.

Further, it is preferable to use a sponge, which functions to absorb water contained in food or filter impurities contained in the food, as the filter 84.

The heater 16 is placed in front of the cover 14 to be able to seal the open end of the vacuum packaging bag after a vacuumizing operation.

As shown in FIG. 2, there is mounted on a top surface of the hood 20 a display panel 40 equipped with a vacuum control unit for controlling a vacuum state of the pump, a pump operating switch, and a cancel button for stopping the operation of the vacuum packaging machine. A compression button (not shown) is placed on the side of the display panel 40.

Further, the hood 20 preferably has a shape in which a ridge is formed at a certain angle around a center portion thereof, which is because the shape reduces the fatigue when the user manually presses the hood.

As shown in FIG. 3, locking hooks 26 are formed at both ends of the hood 20 and catches 18 are formed in the housing 10 to be locked with the locking hooks 26.

As shown in FIG. 8, each of the catches 18 is comprised of a catching bar 18*a* having one end held by the housing 10 and the other end operated in conjunction with a stepping motor S, and a connection member 18*b* for connecting the catching bar 18*a* to a rotation shaft X of the stepping motor S.

In order to bring the rubber packing 12 mounted in the cover 11*b* and the rubber packing 22 mounted in the hood 20 into tight contact with each other and form a vacuum in the space therebetween, if the user presses the hood 20 down and then operates the compression button (not shown), the connection member 18*b* connected to the rotation shaft X of the stepping motor moves the catching bar 18*a* downward, and then the catching bar 18*a* in turn forces the locking hook 26 down, thus compressing the rubber packings 12 and 22 to such an extent that external air does not flow into the space between the rubber packings 12 and 22.

Further, it is preferable to provide a stopper (not shown) for stopping the catching bar 18*a* so that the catching bar 18*a* moves downward by a certain distance.

Further, although not shown in the drawings of the present specification, the catch can be constructed so that it is comprised of two catching bars each having one end held by the housing and the other end operated in conjunction with the stepping motor, and the two catching bars are connected to each other through a fixing portion, thus enabling the catch to act forcefully on the locking hook moving it down.

Reference character P, not described, is an insertion hole into which the locking hook 26 is inserted.

As shown in FIGS. 9*a* and 9*b*, the roll cartridge 30 attached to the rear wall of the housing 10 is comprised of a body 31 in which a roll bar B with the vacuum packaging bag 50 wound thereon is mounted and on which locking projections 32 are formed, the vacuum packaging bag 50 wound around the roll bar B, and a cover 34 for protecting the vacuum packaging bag 50. The cover 34 is rotated around a rotation shaft 34*a* formed on an external circumference of the body 31 at a certain angle. The roll cartridge 30 is characterized in that it is provided with a stopper (not shown) on the body 31 so that the cover 34 is rotated only at the certain angle.

Further, locking holes (not shown) are formed in the housing 10, so that the locking protections 32 formed on the roll cartridge 30 can be inserted into the locking holes.

Further, it is preferable to mount a cutting means 36 on the cover 34 to cut and use the vacuum packaging bag 50 in a certain length, wherein the cutting means 36 may cut the vacuum packaging bag 50 while moving along a slot 36*a* formed in the cover 34.

The cutting means 36 is comprised of a cutter 36*c* for cutting the vacuum packaging bag 50, a casing 36*b* for accommodating the cutter 36*c*, a handle 36*e* gripped by the user to move the cutter 36*c* along the slot 36*a*, and a fastening portion 36*d* integrated with the casing 36*b*, thus securely fastening the vacuum packaging bag.

Further, a spring S is placed below the handle 36*e* to prevent any injury to the user by the cutter 36*c* when the cover 34 is turned up, so that the vacuum packaging bag can be cut by pressing the handle 36*e*.

Further, another embodiment of the present invention is described with reference to FIGS. 6*a* and 6*b* and FIG. 7, in which a description of the same components as those of the above embodiment is omitted. The vacuum packaging machine 100 of the present invention shown in FIG. 6*a* is constructed to comprise a housing 10 having a separation assembly 11 with a rubber packing 12 attached thereto and a heater 16 placed a certain distance directly in front of the separation assembly 11 and used to seal a vacuum packaging bag, a hood 20 hingedly connected to a portion of the housing 10 and rotated at a certain angle to selectively open and close the housing 10, and a vacuum packaging bag roll cartridge 30 detachably attached to a rear wall of the housing 10.

The separation assembly 11 of the housing 10 is comprised of a separation assembly casing 11*a* with an outlet 110*a* formed therein, and a cover 11*b* mounted on the casing 11*a* and provided with an inlet 110*b* formed in a top surface thereof. A groove 112*b* for allowing the rubber packing 12 to be mounted therein is formed in the border of the cover 11*b*, so that the rubber packing 12 can be inserted into the groove 112*b*.

The rubber packing 12 is designed so that a plurality of projections 12*a* are oppositely formed along an inner circumference thereof and an entire structure of the rubber packing 12 forms a belt shape. The number of projections 12*a* is preferably 2 to 20.

A certain groove (not shown) is formed in the outside of the bottom surface of the cover 11*b* to allow the cover 11*b* to be detachably attached to the separation assembly casing 11*a*.

The outlet 110*a* formed in the separation assembly casing 11*a* communicates with a pump (not shown) to vacuumize the vacuum packaging bag through a tube.

At the time of the vacuumizing operation, the oil and water flowing out from contents contained in the vacuum packaging bag drops to the cover 11*b* of the separation assembly 11, flows into the inlet 110*b* formed in the cover 11*b*, and is then stored in the separation assembly casing 11*a*. Further, air is discharged through the outlet 110*a*.

As described above, the separation assembly 11 is formed, so that the oil and water having remained in the vacuum packaging bag is separated from the vacuum packaging bag and stored in the separation assembly casing 11*a*, and the air flowing out from the vacuum packaging bag is discharged to the outside of the separation assembly 11 through the outlet 110*a*.

Further, it is preferable to form the cover 11*b* to have a certain gradient to allow any oil or water to rapidly flow into the inlet.

Further, a depression 13 is formed in the housing 10 and detaching members 11*c* are formed at both ends of the separation assembly 11, so that the separation assembly 11 can be detachably attached to the depression 13 through the detaching members 11*c*.

Further, the separation assembly 11 can be constructed so that, at the time of the vacuumizing operation, a water level control sensor (not shown) is mounted in the separation assembly casing 11*a*, and then the pump 14 is stopped when oil or impurities filled into the separation assembly casing 11*a* increase to a certain level or more, thus preventing the occurrence of a phenomenon in which any oil or water flows into the pump to deteriorate performance of the pump.

As shown in FIG. 7, a receiving part 23 is formed in an inner portion of the hood 20 to allow the rubber packing 22 to be inserted thereinto. The rubber packing 22 is provided with a plurality of rectangle-shaped holes 22*a* formed therein, and vacuum spaces are formed when channel parts 12*b* of the rubber packing 12 mounted on the cover 11*b* and the rectangle-shaped holes 22*a* come into contact with each other.

The rubber packings 12 and 22 are constructed as described above, so that a contact area is widened when the rubber packings 12 and 22 come into contact with each other, thus securely intercepting air flowing from the outside of the rubber packings. Further, the channel parts 12*b* are formed in the rubber packing 12, so that an area of the vacuum spaces is minimized, thus reducing a vacuumizing time.

Further, as shown in FIG. 6*b*, the rubber packings 12 and 22 can be constructed so that the rubber packing 12 inserted into a cover (not shown) of the housing 10 is provided with a plurality of rectangle-shaped holes 12*c* formed therein, and the rubber packing 22 inserted into the inner portion of the hood 20 is provided with a plurality of cross-shaped holes 22*c* formed at locations corresponding to those of the rectangle-shaped holes 12*b* in the rubber packing 12. In this case, the cross-shaped holes 22*c* each have both side notches by which channel grooves 220*c* are formed. Therefore, vacuum spaces are formed when the rectangle-shaped holes 12*c* and the cross-shaped holes 22*c* come into contact with each other.

Hereinbefore, the construction of the vacuum packaging machine was described with reference to FIGS. 2 to 9. Hereinafter, a system for controlling the vacuum packaging machine is described in detail.

Figure 10:
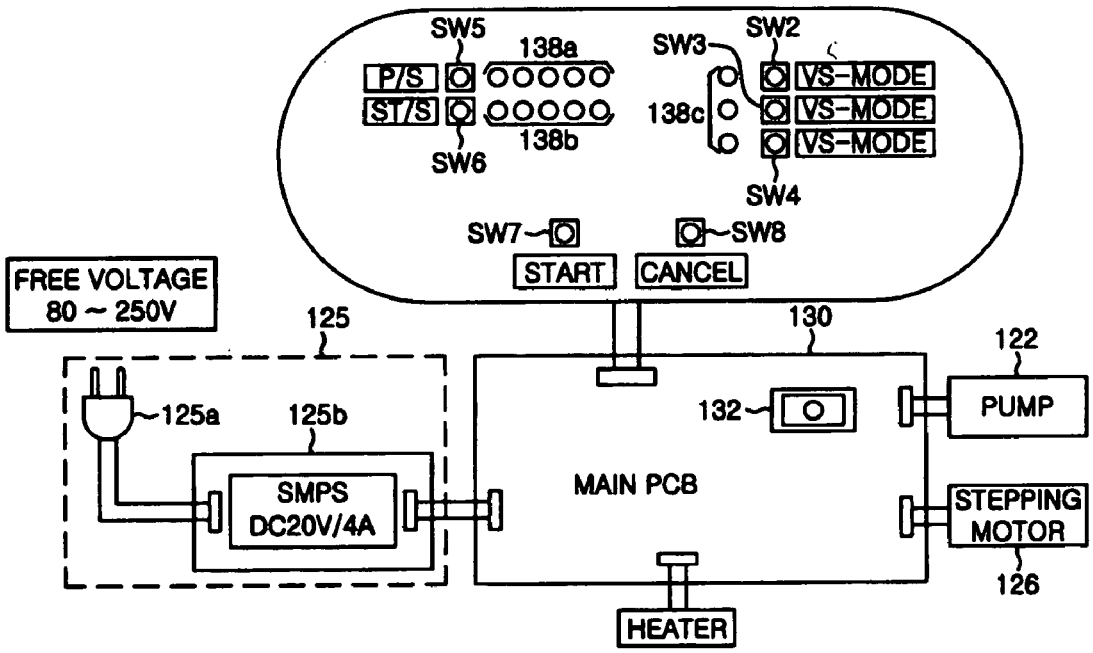
FIG. 10 is a view showing the construction of a system for controlling the vacuum packaging machine according to the present invention.
Figure 11:
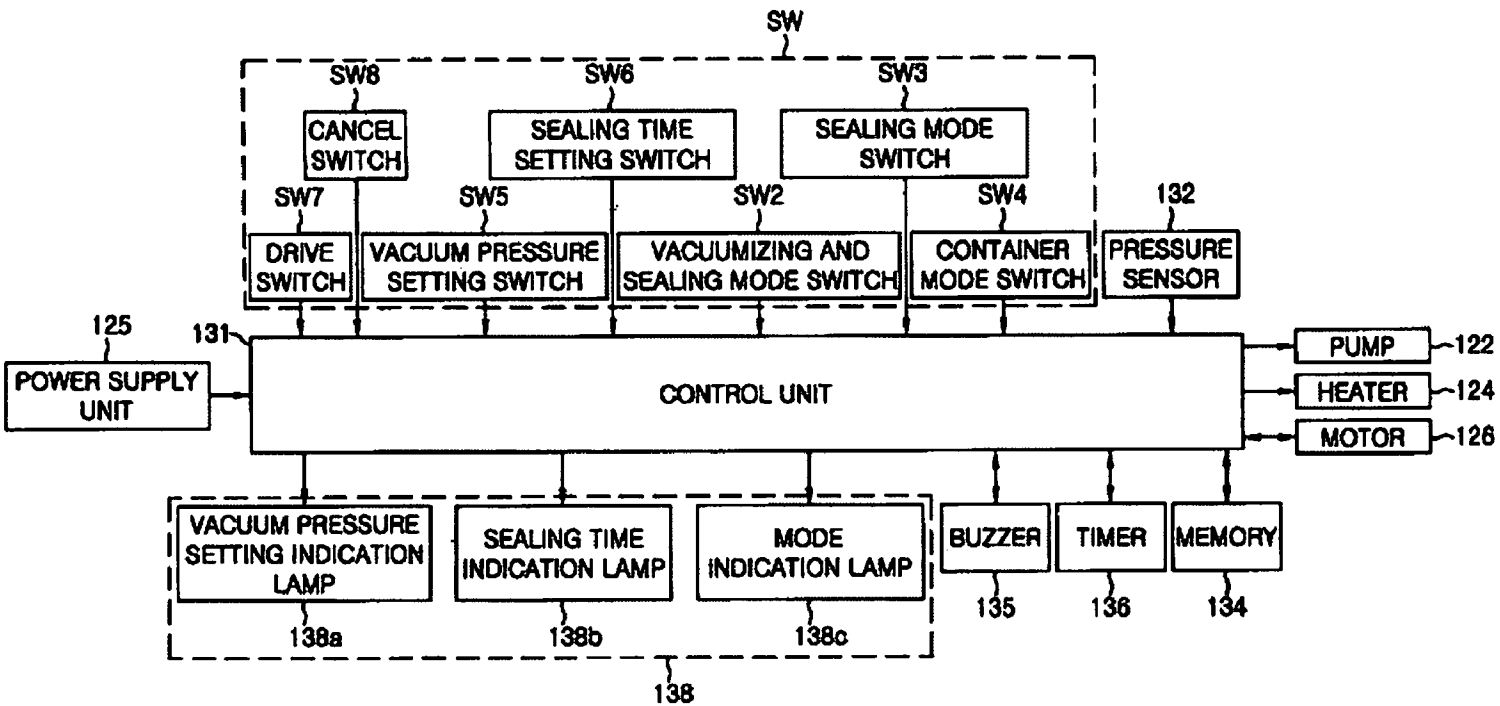
FIG. 11 is a block diagram of the system for controlling the vacuum packaging machine according to the present invention.

Referring to FIGS. 10 and 11, the vacuum packaging machine control system of the present invention is constructed to comprise a power supply unit 125, which is provided on or electrically connected to a main printed circuit board (PCB) 130 forming a control panel 40 and supplies power so as to drive various components of the vacuum packaging machine, a switch unit SW for supplying/shutting off the power and selecting various modes after the power is supplied from the power supply unit 125, a pressure sensor 132 for measuring (detecting) a vacuum pressure formed by a pump 122, a display unit 138 for receiving electrical signals from the switch unit SW and the pressure sensor 132 and then displaying operating states of the vacuum packaging machine, a motor 126 supplied with the power from the power supply unit 125 and driven thereby so as to wind a packaging paper in the roll cartridge 30 according to a preset program, a heater 124 for heating and sealing the packaging paper at a predetermined temperature, a control unit 131 for controlling the operations of the respective driving units, a memory 134 for storing therein input/output data of the control unit 131, and a timer 136 for providing time information to the control unit 131. In the meantime, the control unit 131 is electrically connected to a buzzer 135 for outputting an alarm when a preset program is executed during the operation of the vacuum packaging machine.

The power supply unit 125, which converts received typical alternating current (AC) power into a direct current (DC) voltage and outputs the DC voltage, functions to apply operating power to the respective driving units constituting a control circuit of the vacuum packaging machine and operates in a Switching Mode Power Supply (SMPS) manner.

The SMPS is mainly applied to civilian and industrial appliances requiring small sizes, light weights and large capacities as at the present time, and operated to convert an AC line frequency of 50 to 60 Hz into a high frequency and then output a constant voltage. That is, the SMPS is designed so that a conventional power supply scheme having limitations in efficiency, weight and capacity is improved to be suitable especially for low-cost, mass production systems, thus performing an overcurrent protection function. Accordingly, the high efficiency and high reliability of appliances employing the SMPS can be obtained. The power supply unit 125 according to the embodiment of the present invention as operated above is implemented using a constant voltage unit 125*b* for receiving a free voltage of 80 to 125V through a power plug 125*a* and outputting a constant DC voltage of 20V.

A stepping motor for receiving an electrical signal output from the control unit 131 to perform precise angle control is used as the motor 126. The heater 124 can be implemented as one of the typical various heaters each supplied with the DC voltage through the power supply unit 125 to generate heat at a predetermined temperature.

The switch unit SW is comprised of respective mode selection switches used to set modes by the user after the power is supplied from the power supply unit 125, including a vacuumizing and sealing mode switch SW2 to automatically and sequentially perform vacuumizing and sealing functions, a sealing mode switch SW3 to perform only a sealing function, and a container mode switch SW4 to select a container mode for the sealing of a container, a vacuum pressure setting switch SW5 to set a vacuum pressure after mode selection is performed through the mode switches SW2, SW3 and SW4, a sealing time setting switch SW6, a drive switch SW7 to select the drive of the vacuum packaging machine after data are set through the switches SW5 and SW6, and a cancel switch SW8 to stop the drive of the vacuum packaging machine.

The pressure sensor 132 is implemented as an electronic pressure sensor requiring high precision, not a conventional mechanical pressure sensor having unstable data and low sensitivity, so as to improve the reliability of the data and sensitivity.

The control unit 131 is implemented by an Integrated Circuit (IC) which integrally controls all operations of the vacuum packaging machine and displays of the operating states thereof.

The display unit 138, which is operated in response to data output from the control unit 131, is constructed to comprise a total of five vacuum pressure setting indication lamps 138*a* for displaying corresponding set values whenever the user sets a vacuum pressure through the vacuum pressure setting switch SW5, a total of five sealing time indication lamps 138*b* for displaying corresponding set values whenever the user sets a sealing time through the sealing time setting switch SW6, and a total of three mode indication lamps 138*c* for displaying items selected through the vacuumizing and sealing mode switch SW2, the sealing mode switch SW3 and the container mode switch SW4.

The memory 134 is implemented as an Electrically Erasable Programmable Read Only Memory (EEPROM). The timer 136 functions to count intervals at which the vacuum pressure setting switch SW5 is pressed, that is, 0.25 seconds set in the embodiment of the present invention.

In the meantime, the buzzer 135 functions to output an alarm when a time set through the sealing time setting switch SW6 is terminated.

Hereinafter, operations and effects of the vacuum packaging machine of the present invention are described according to control flows thereof with reference to FIGS. 12*a* to 12*e*.

First, a power cord (the power plug 125*a*) is inserted into a wall socket (not shown) to supply power to the vacuum packaging machine at step 200. If the power is supplied in this way, it is determined whether a previously set menu item is normally displayed at step 202. If the previously set menu item is not normally displayed, a power supply state is examined, while if the set menu item is normally displayed, the user selects desired modes through the mode switches SW2, SW3 and SW4 at step 205. Then, it is determined whether a selection mode is a vacuumizing and sealing mode at step 204.

First, if the selection mode is not a vacuumizing and sealing mode, it is determined whether the selection mode is a sealing mode and a container mode, and then corresponding data are received. At this time, if the selection mode is the vacuumizing and sealing mode, the user sets a suitable vacuum pressure through the vacuum pressure setting switch SW5 at step 206, and thereafter sets a suitable sealing time through the sealing time setting switch SW6 at step 208.

As described above, at the time of setting the sealing time, it is determined whether the drive switch SW7 is pressed for 0.25 seconds or longer at step 210. If the drive switch SW7 is pressed, a vacuumizing progress at this time is displayed through the vacuum pressure setting indication lamps 138*a* at the same time that the pump 122 is operated (a first stage operation of a door press) at step 212. The door press first stage represents a stage in which only the pump 122 is operated and a vacuum is smoothly formed by a relatively small pressing force.

Thereafter, it is determined whether a current vacuum pressure has reached the set vacuum pressure at step 214. If it is determined that the current vacuum pressure does not reach the set vacuum pressure and the cancel switch is pressed for 0.25 seconds at step 216, the operation of the vacuum packaging machine is stopped. If the current vacuum pressure has reached the set vacuum pressure, a time elapsed from the initiation of the sealing is displayed through corresponding lamps at the same time that both the pump 122 and the heater 126 are operated (a door press second stage) at step 218. The door press second stage represents a stage in which heating for complete sealing is executed through the heater 126 at the same time that the pump 122 is operated, and a pressing force generally stronger than that of the door press first stage acts. In this way, the vacuum packaging machine has an advantage of shortening an operating time compared to a typical vacuum packaging machine.

In the meantime, it is determined whether the set sealing time has elapsed at step 220. If it is determined that the set sealing time does not elapse and the cancel switch SW8 is pressed for 0.25 seconds or longer at step 221, the operation of the vacuum packaging machine is stopped. If it is determined that the set sealing time has elapsed, a stop alarm is output three times through the buzzer 135 at the same time that the operations of both the pump and the heater are stopped at step 222.

Continuously, it is determined whether the vacuumizing and sealing operations are satisfactorily performed at step 224. If the vacuumizing and sealing operations are satisfactorily performed, the operation of the vacuum packaging machine is stopped; otherwise it is determined whether the vacuumizing operation is satisfactorily performed at step 226. If the vacuumizing operation is not satisfactorily performed, a suitable vacuum pressure is reset, while if the vacuumizing operation is satisfactorily performed, it is determined whether the sealing operation is satisfactorily performed at step 228. If the sealing operation is not satisfactorily performed, a suitable sealing time is reset, while if the sealing operation is satisfactorily performed, the operation of the vacuum packaging machine is stopped.

Figure 12A:
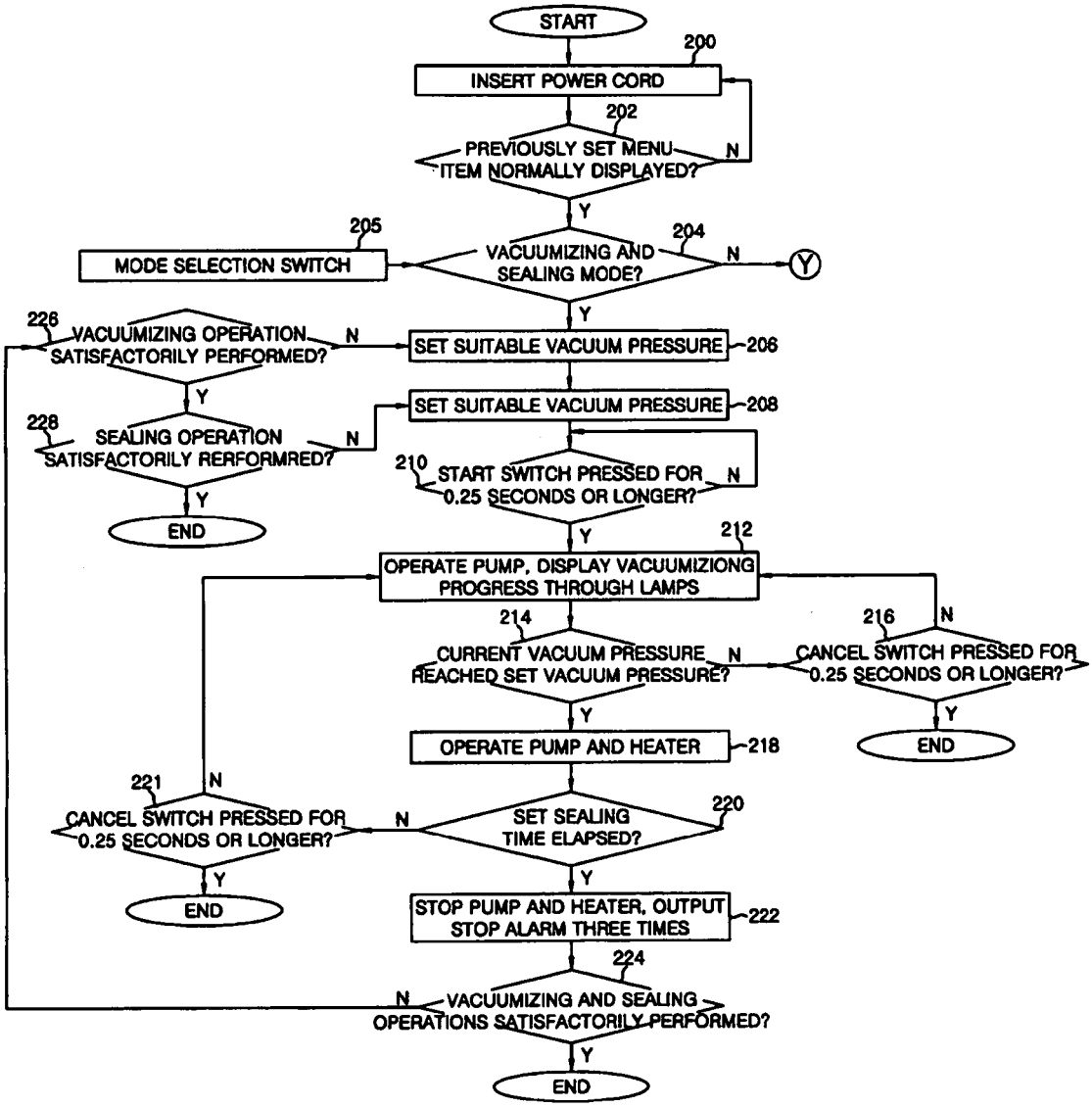
FIGS. 12*a* to 12*e* are flowcharts of a method of controlling the vacuum packaging machine according to the present invention.
Figure 12B:
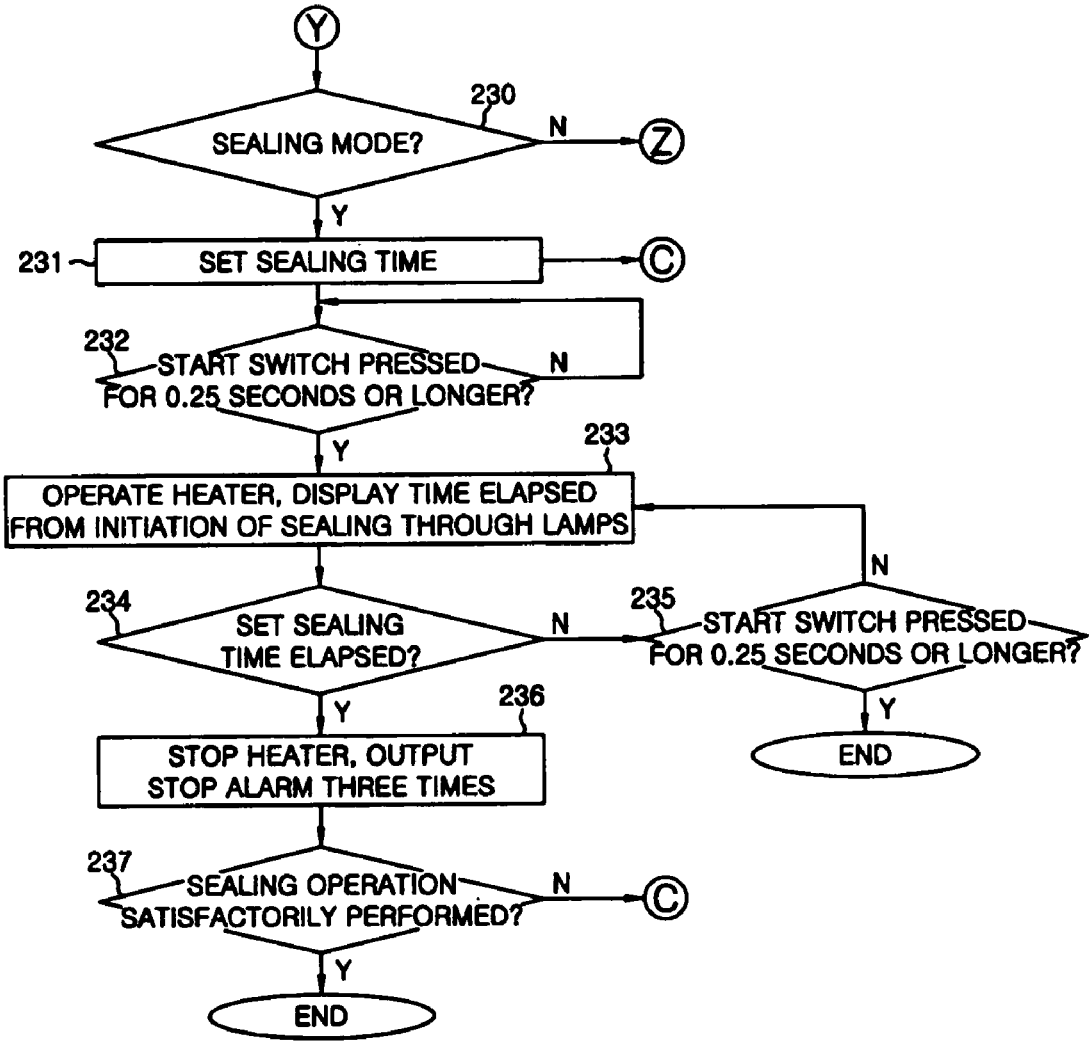

Referring to FIG. 12*b*, it is determined whether a mode selected through the mode selection switches is a sealing mode at step 230. If the selection mode is the sealing mode, the user sets a sealing time through the sealing time setting switch SW6 at step 231. Thereafter, it is determined whether the drive switch SW7 is pressed for 0.25 seconds or longer at step 232. If the drive switch SW7 is pressed for 0.25 seconds or longer, the corresponding sealing time is displayed through the lamps at the same time that the heater 124 is operated at step 233. Thereafter, it is determined whether the set sealing time has elapsed at step 234. If the set sealing time has elapsed, the operation of the heater 124 is stopped, and a stop alarm is output three times through the buzzer 135 at step 236. Thereafter, it is determined whether the sealing operation is satisfactorily performed at step 237. If the sealing operation is satisfactorily performed, the operation of the vacuum packaging machine is stopped; otherwise a sealing time is reset.

In the meantime, if the set sealing time does not elapse at step 234, it is determined whether the cancel switch SW8 is pressed for 0.25 seconds or longer at step 235. If the cancel switch SW8 is pressed for 0.25 seconds or longer, the operation of the vacuum packaging machine is stopped; otherwise the heater is operated and a time elapsed from the initiation of the sealing is displayed through corresponding lamps at step 233.

Figure 12C:
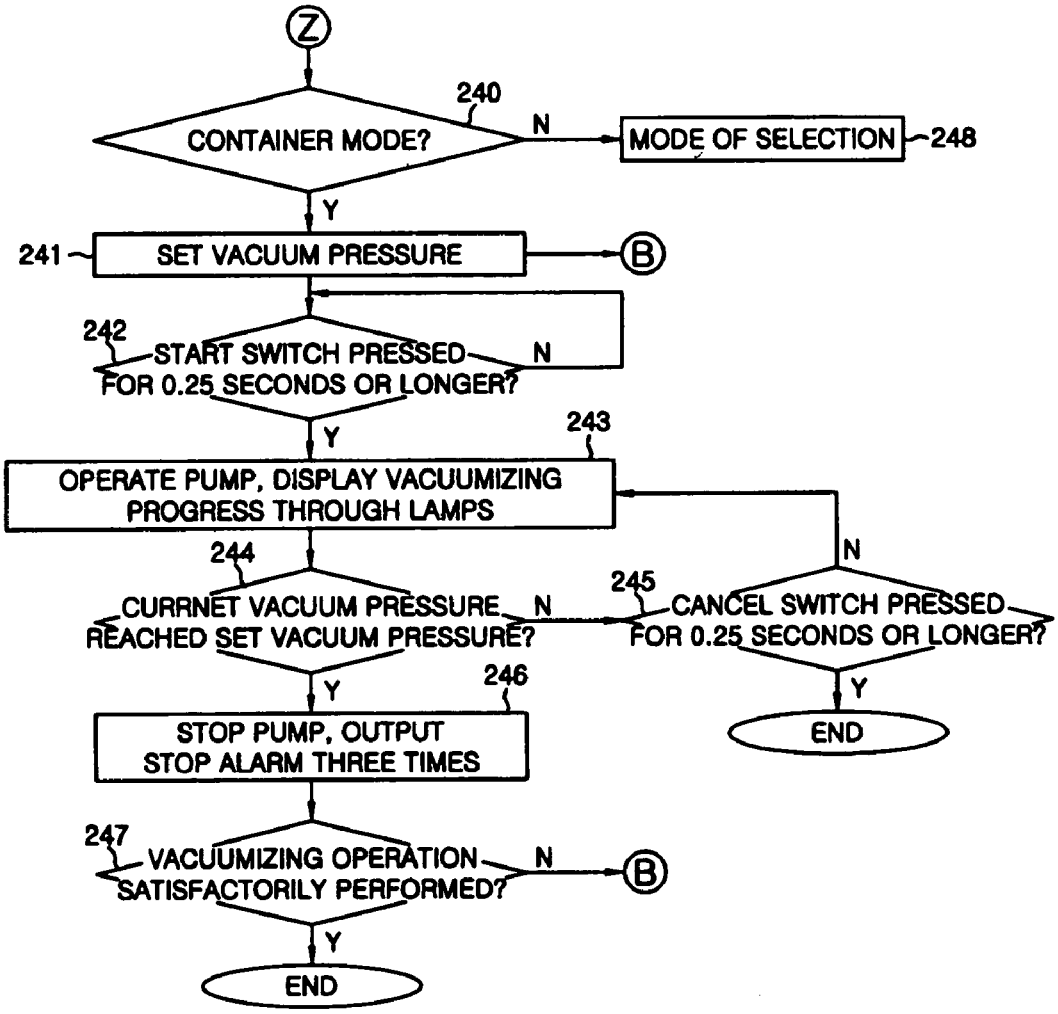

Referring to FIG. 12*c*, it is determined whether a mode selected through the mode selection switches at step 248 is a container mode at step 240. If the selection mode is the container mode, a suitable vacuum pressure is set at step 241. Thereafter, it is determined whether the drive switch SW7 is pressed for 0.25 seconds or longer at step 242. If the drive switch SW7 is pressed for 0.25 seconds or longer, a vacuumizing progress is displayed through the lamps at the same time that the pump 122 is operated at step 243, and then it is determined whether a current vacuum pressure has reached the set vacuum pressure at step 244. If the current vacuum pressure has reached the set vacuum pressure, a stop alarm is output three times through the buzzer 135 at the same time that the operation of the pump is stopped at step 246. Thereafter, it is determined whether a vacuumizing operation is satisfactorily performed at step 247. If the vacuumizing operation is satisfactorily performed, the operation of the vacuum packaging machine is stopped; otherwise a vacuum pressure is reset.

In the meantime, if the current vacuum pressure does not reach the set vacuum pressure, it is determined whether the cancel switch SW8 is pressed for 0.25 seconds or longer at step 245. If the cancel switch SW8 is pressed for 0.25 seconds or longer, the operation of the vacuum packaging machine is stopped; otherwise the above step 243 for operating the pump and displaying the vacuumizing progress through the lamps is performed.

Figure 12D:
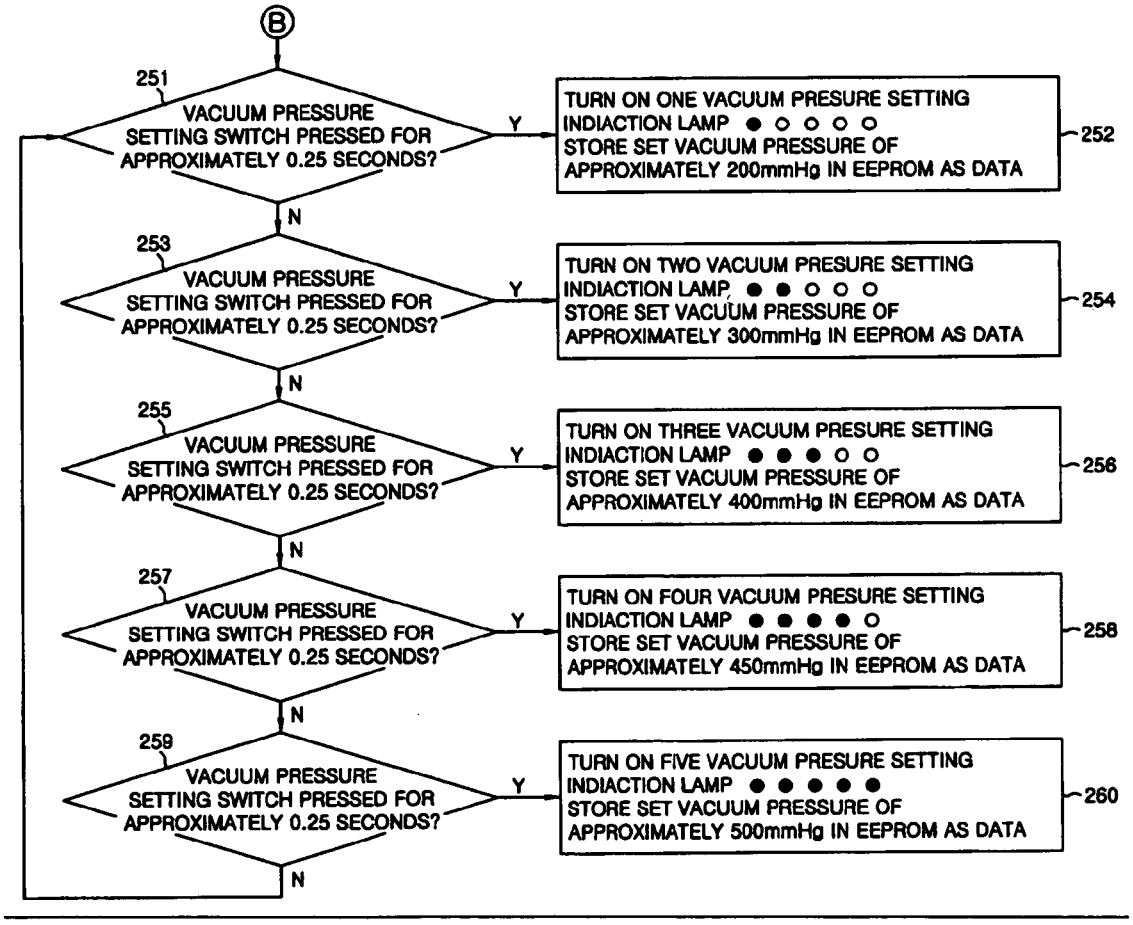

Referring to FIG. 12*d*, the resetting of a vacuum pressure can be adjusted by pressing the vacuum pressure setting switch SW5. The user selects preset data whenever pressing the vacuum pressure setting switch SW5. In the meantime, the vacuum pressure setting switch SW5 counts time on the basis of time information provided from the timer 136. The embodiment of the present invention is implemented so that, if the vacuum pressure setting switch is pressed for 0.25 seconds, a switch press signal is detected. That is, if the user presses the vacuum pressure setting switch SW5 once at step 251, a vacuum pressure of approximately 200 mmHg is stored in the memory 134 at the same time that one vacuum pressure setting indication lamp 138*a* is turned on at step 252. If the user presses the vacuum pressure setting switch SW5 again at step 253, a vacuum pressure of approximately 300 mmHg is stored in the memory 134 at the same time that two vacuum pressure setting indication lamps 138*a* are turned on at step 254. If the user presses the vacuum pressure setting switch SW5 yet again at step 255, a vacuum pressure of approximately 400 mmHg is stored in the memory 134 at the same time that three vacuum pressure setting indication lamps 138*a* are turned on at step 256. If the user presses the vacuum pressure setting switch SW5 yet again at step 257, a vacuum pressure of approximately 450 mmHg is stored in the memory 134 at the same time that four vacuum pressure setting indication lamps 138*a* are turned at step 258. If the user presses the vacuum pressure setting switch SW5 yet again at step 259, a vacuum pressure of 500 mmHg is stored in the memory 134 at the same time that five vacuum pressure setting indication lamps 138*a* are turned on at step 260.

Figure 12E:
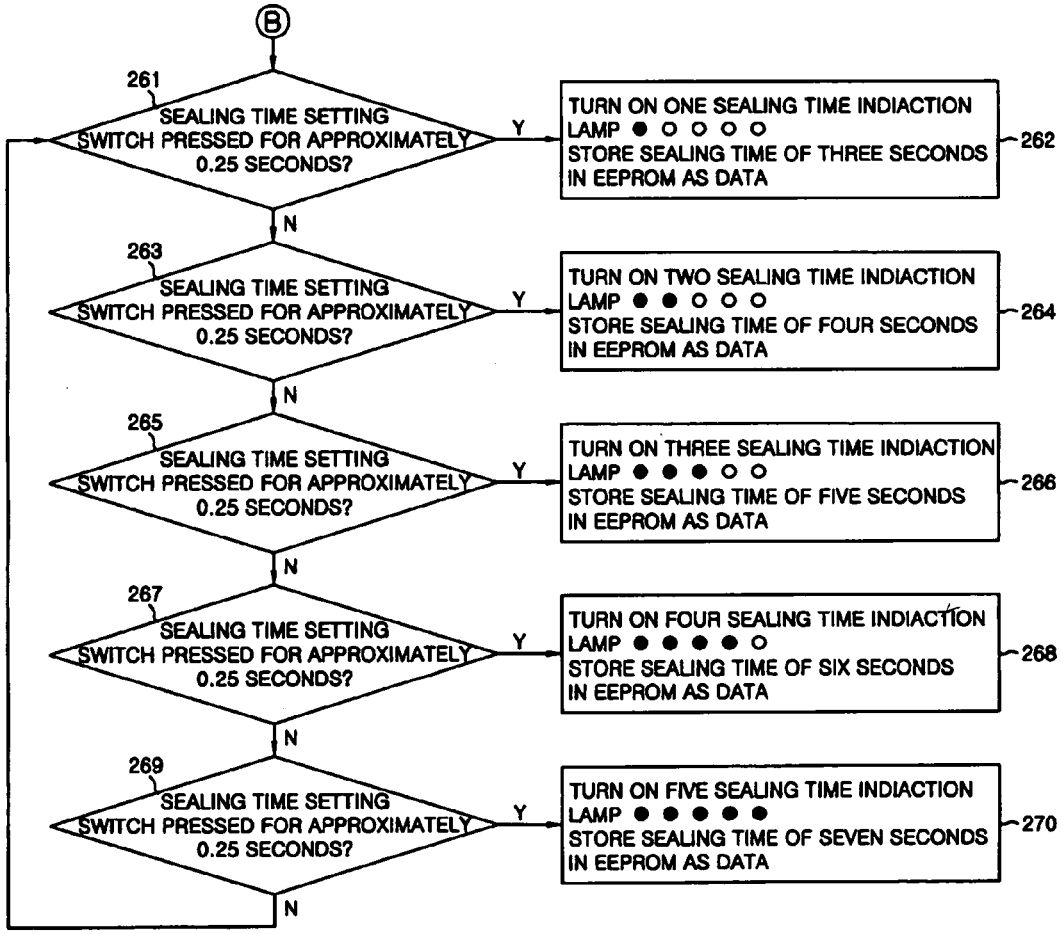

Referring to FIG. 12*e*, the resetting of a sealing time can be adjusted by pressing the sealing time setting switch SW6. Therefore, the user can select preset data whenever pressing the sealing time setting switch SW6. In the meantime, the sealing time setting switch SW6 counts time on the basis time information provided from the timer 136. The embodiment of the present invention is implemented so that, if the sealing time setting switch SW6 is pressed for 0.25 seconds, a switch press signal is detected. That is, if the user presses the sealing time setting switch SW6 once at step 261, a sealing time of three seconds is stored in the memory 134 at the same time that one sealing time indication lamp 138*b* is turned on at step 262. If the user presses the sealing time setting switch SW6 again at step 263, a sealing time of four seconds is stored in the memory 134 at the same time that two sealing time indication lamps 138*b* are turned on at step 264. If the user presses the sealing time setting switch SW6 yet again at step 265, a sealing time of five seconds is stored in the memory 134 at the same time that three sealing time indication lamps 138*b* are turned on at step 266. If the user presses the sealing time setting switch SW6 yet again at step 267, a sealing time of six seconds is stored in the memory 134 at the same time that four sealing time indication lamps 138*b* are turned at step 268. If the user presses the sealing time setting switch SW6 yet again at step 269, a sealing time of seven seconds is stored in the memory 134 at the same time that five sealing time indication lamps 138*b* are turned on at step 270.

As described above, the vacuum packaging machine of the present invention is operated in such a way that, if the drive switch SW7 is operated in a one-touch manner and thus an electrical signal is applied to the control unit 131 after the user sets desired modes and required data through the mode selection switches and corresponding setting switches of the switch unit SW, vacuumizing and sealing operations are sequentially performed according to a preset program. In this case, the present invention is advantageous in that an operating time of the vacuum packaging machine is shortened compared to a conventional vacuum packaging machine, and the operation of the vacuum packaging machine is stably performed.

As described above, the present invention provides a vacuum packaging machine, which selectively eliminates dregs and water flowing out from food contained in a vacuum packaging bag at the time of vacuumizing and sealing by connecting an outlet formed in a cover to a separation unit, eliminates user's inconvenience of manually pressing a hood to form a vacuum by utilizing catches capable of closely pushing locking hooks formed on the hood, and cuts and utilizes the vacuum packaging bag in a required length by attaching a roll cartridge to a housing.

Further, the vacuum packaging machine control system of the present invention is advantageous in that it allows the vacuum packaging machine to be automatically operated in a one-touch manner and, especially, operated to be supplied with power in a Switching Mode Power Supply (SMPS) manner, so that the vacuum packaging machine can be stably operated and then a conventional problem in which lifespan of the vacuum packaging machine is shorter can be solved, thus prolonging the lifespan of the vacuum packaging machine.

Further, the vacuum packaging machine control system of the present invention is advantageous in that it utilizes an electronic sensing means (a pressure sensor), without utilizing a conventional mechanical sensing means which was used to sense a vacuum by the activation of a pump, thus improving reliability of sensed data while facilitating the sensing of the vacuum.

Further, the vacuum packaging machine control system of the present invention is advantageous in that it facilitates selecting operations through a switch unit, and easily monitors the operating states of the vacuum packaging machine including the switch selection, thus improving convenience when using the vacuum packaging machine.

Moreover, the vacuum packaging machine control system of the present invention is expectably advantageous in that it can shorten an operating time of the vacuum packaging machine compared to that of a conventional vacuum packaging machine, and it can be easily applied to various packaging apparatuses in the same industrial fields.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vacuum packaging machine, comprising:

a housing having a cover with a rubber packing attached to a border thereof and an outlet formed therein, and a heater for sealing a vacuum packaging bag;

a hood hingedly connected to the housing to selectively open and close a top of the housing, the hood having a rubber packing; and a separation unit communicating with the outlet through a communicating member and connected to a vacuum pump;

wherein the vacuum packaging machine forms a vacuum through the vacuum pump when the rubber packings of both the hood and the housing come into contact with each other;

wherein the separation unit comprises an inlet port, an outlet port and a partition configured to couple both the inlet and outlet ports to a sidewall of the housing; and wherein the inlet and outlet ports of the separation unit are detachably and selectively coupled to one of a communication pipe and a filter configured to filter out impurities and oil contained in the vacuum packaging bag;

wherein the housing includes at least one catch; the hood includes one locking hook formed thereon to be locked with the catch; the catch pushes the locking hook down, and thus a vacuum is formed in vacuum spaces;

wherein the catch includes a catching bar having a first end held by the housing and a second end operated in conjunction with a stepping motor; and a connection member for connecting the catching bar to a rotation shaft of the stepping motor.

2. The vacuum packaging machine according to claim 1, wherein the filter means comprises a filter casing, a filter inserted into the filter casing to eliminate the impurities, and a filter casing cover.

3. A vacuum packaging machine, comprising:

a housing having a separation assembly with a rubber packing attached to a border thereof and a heater for sealing a vacuum packaging bag, the separation assembly including a separation assembly casing having an outlet formed therein configured to communicate with a pump, a cover mounted on the casing and provided with an inlet formed in a top surface thereof and a rubber packing; and a hood hingedly connected to the housing to selectively open and close a top of the housing, the hood having a rubber packing;

wherein the vacuum packaging machine forms a vacuum through a pump when the rubber packings of both the hood and the housing come into contact with each other;

wherein the separation assembly is disposed within a depression formed in the housing and is detachable from the housing;

wherein the rubber packing disposed within the cover of the housing is configured such that a plurality of projections are oppositely formed along an inner circumference thereof and channel parts are formed therein at locations where the projections face each other; and wherein the rubber packing disposed within the hood is configured such that a plurality of holes are formed therein at locations corresponding to the channel parts forming vacuum spaces when the channel parts and the holes come into contact with each other.

4. The vacuum packaging machine according to claim 3, wherein:

the rubber packing inserted into the cover of the housing is constructed so that a plurality of holes are formed therein; and the rubber packing inserted into the hood is constructed so that a plurality of each having both side notches by which channel grooves are formed are formed at locations corresponding to those of the holes in the rubber packing inserted into the cover, so that vacuum spaces can be formed when the holes of the cover and the hood come into contact with each other.

5. The vacuum packaging machine according to claim 1, wherein the catch includes two catching bars each having a first end held by the housing and a second end operated in conjunction with a stepping motor, the two catching bars being connected to each other through a fixing portion.

6. The vacuum packaging machine according to claim 1, wherein the housing is provided with a stopper, so that the stepping motor stops an operation thereof when the catching bar is locked with the stopper.

7. The vacuum packaging machine according to claim 5, wherein the housing is provided with a stopper, so that the stepping motor stops an operation thereof when the catching bar is locked with the stopper.

8. The vacuum packaging according to claim 1, further comprising a roll cartridge containing a vacuum packaging bag roll, the roll cartridge being attached to a rear wall of the housing.

9. The vacuum packaging machine according to claim 8, wherein:

the housing includes a locking hole formed therein; and the roll cartridge includes a locking projection formed thereon to be detachable from the locking hole.

10. The vacuum packaging machine according to claim 9, wherein the roll cartridge includes a cover mounted thereon to protect the vacuum packaging bag, the cover being rotated around a rotation shaft formed on an outer circumference of the roll cartridge at a predetermined angle.

11. The vacuum packaging machine according to claim 10, wherein the cover includes cutting means mounted thereon to allow the vacuum packaging bag to be cut and used in a certain length.

12. The vacuum packaging machine according to claim 11, wherein the cover includes a slot formed therein to allow the cutting means to cut the vacuum packaging bag while moving along the slot.

13. The vacuum packaging machine according to claim 11, wherein the cutting means includes a cutter, a casing for accommodating the cutter and a handle for allowing the cutter to cut the vacuum packaging bag while moving the cutter along the slot.

14. The vacuum packaging machine according to claim 13, wherein the cutting means includes a fastening portion placed below the cutter, thus securely fastening the vacuum packaging bag at the time of cutting operation.

* * * * *